US010591192B2

(12) United States Patent
Yokozeki et al.

(10) Patent No.: US 10,591,192 B2
(45) Date of Patent: Mar. 17, 2020

(54) HEAT EXCHANGE APPARATUS AND AIR CONDITIONER USING SAME

(71) Applicant: Johnson Controls-Hitachi Air Conditioning Technology (Hong Kong) Limited, Hong Kong (CN)

(72) Inventors: Atsuhiko Yokozeki, Tokyo (JP); Hiroaki Tsuboe, Tokyo (JP); Yoshiharu Tsukada, Tokyo (JP); Yuki Arai, Tokyo (JP)

(73) Assignee: Hitachi-Johnson Controls Air Conditioning, Inc., Tokyo (JP)

( * ) Notice: Subject to any disclaimer, the term of this patent is extended or adjusted under 35 U.S.C. 154(b) by 0 days.

(21) Appl. No.: 15/531,821

(22) PCT Filed: Feb. 27, 2015

(86) PCT No.: PCT/JP2015/055730
§ 371 (c)(1),
(2) Date: May 31, 2017

(87) PCT Pub. No.: WO2016/135935
PCT Pub. Date: Sep. 1, 2016

(65) Prior Publication Data

US 2017/0328614 A1 Nov. 16, 2017

(51) Int. Cl.
*F25B 39/00* (2006.01)
*F25B 13/00* (2006.01)
(Continued)

(52) U.S. Cl.
CPC ..... *F25B 39/00* (2013.01); *F25B 13/00* (2013.01); *F25B 39/04* (2013.01); *F25B 40/02* (2013.01);
(Continued)

(58) Field of Classification Search
CPC ..... F25B 39/00; F25B 13/00; F25B 39/04; F25B 40/02; F25B 41/062; F25B 39/028;
(Continued)

(56) References Cited

U.S. PATENT DOCUMENTS 2,402,802 A 6/1946 Carter
5,842,351 A 12/1998 Earhart, Jr.
(Continued)

FOREIGN PATENT DOCUMENTS

JP 51-64948 A 5/1976
JP 2003-121029 A 4/2003
(Continued)

OTHER PUBLICATIONS

International Search Report of PCT/JP2015/055730 dated May 19, 2015.
(Continued)

*Primary Examiner* — Melvin Jones
(74) *Attorney, Agent, or Firm* — Mattingly & Malur, PC

(57) ABSTRACT

There are provided a heat exchange apparatus and an air conditioner in which an occurrence of uneven refrigerant distribution of a heat exchanger is reduced such that heat exchange performance improves. The heat exchange apparatus includes: a heat-transfer pipe through which a refrigerant flows; a heat exchanger in which a plurality of the heat-transfer pipes are connected to one another; a distributor that distributes the refrigerant to the plurality of heat-transfer pipes; an inflow pipe that causes the refrigerant to flow into the distributor; and a confluent pipe which is connected to an intermediate position of the inflow pipe and in which the refrigerant flowing through an inside thereof is to merge with the refrigerant flowing through an inside of
(Continued)

the inflow pipe. A merging part between the inflow pipe and the confluent pipe is positioned in the vicinity of the distributor.

8 Claims, 16 Drawing Sheets

(51) Int. Cl.

| | |
|---|---|
| ***F25B 40/02*** | (2006.01) |
| ***F25B 41/06*** | (2006.01) |
| ***F28F 9/02*** | (2006.01) |
| ***F25B 39/02*** | (2006.01) |
| ***F28D 1/047*** | (2006.01) |
| ***F25B 39/04*** | (2006.01) |
| ***F28D 1/04*** | (2006.01) |
| *F28D 21/00* | (2006.01) |

(52) U.S. Cl.
CPC ..... *F25B 41/062* (2013.01); *F28D 1/047* (2013.01); *F28D 1/0435* (2013.01); *F28F 9/0246* (2013.01); *F28F 9/0275* (2013.01); *F25B 39/028* (2013.01); *F25B 2341/0662* (2013.01); *F25B 2500/01* (2013.01); *F28D 2021/0068* (2013.01)

(58) Field of Classification Search
CPC ..... F25B 2341/0662; F25B 2500/01; F28D 1/0435; F28D 1/047; F28D 2021/0068; F28F 9/0246; F28F 9/0275
USPC ..... 62/525
See application file for complete search history.

(56) References Cited

U.S. PATENT DOCUMENTS

| | | | |
|---|---|---|---|
| 2011/0259551 | A1 | 10/2011 | Kasai et al. |
| 2013/0192809 | A1 | 8/2013 | Kim et al. |
| 2015/0047385 | A1 | 2/2015 | Albertson |

FOREIGN PATENT DOCUMENTS

| | | | |
|---|---|---|---|
| JP | 2004-044886 | A | 2/2004 |
| JP | 2008-039233 | A | 2/2008 |
| JP | 2011-145011 | A | 7/2011 |
| JP | 2013-178044 | A | 9/2013 |
| JP | 2014-020678 | A | 2/2014 |
| JP | 2014-222143 | A | 11/2014 |
| JP | 2016135935 | A2 * | 7/2016 |

OTHER PUBLICATIONS

Extended European Search Report received in corresponding European Application No. 15883229.5 dated Sep. 28, 2018.

* cited by examiner

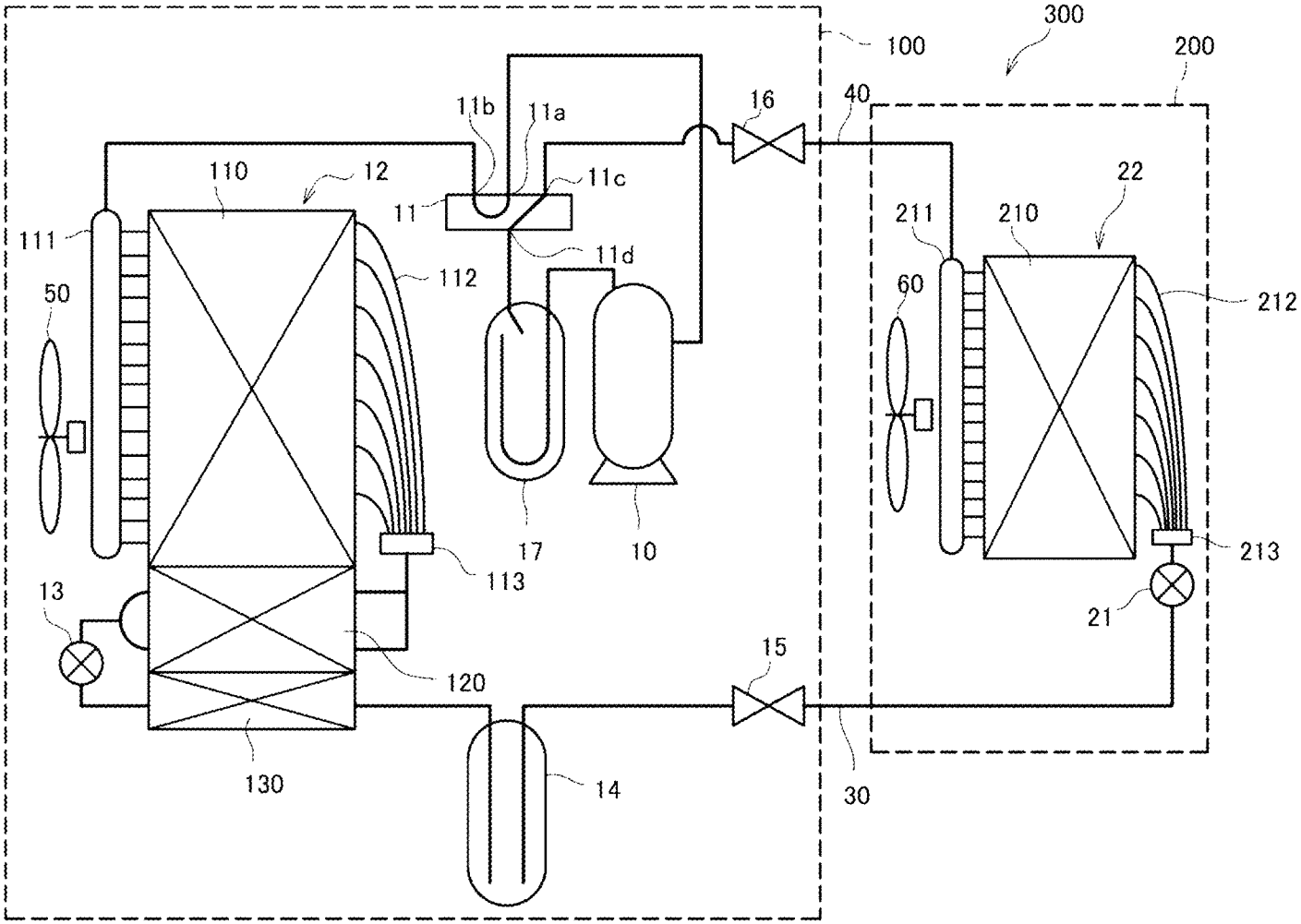
[Fig. 1]

[Fig. 2]
(a)
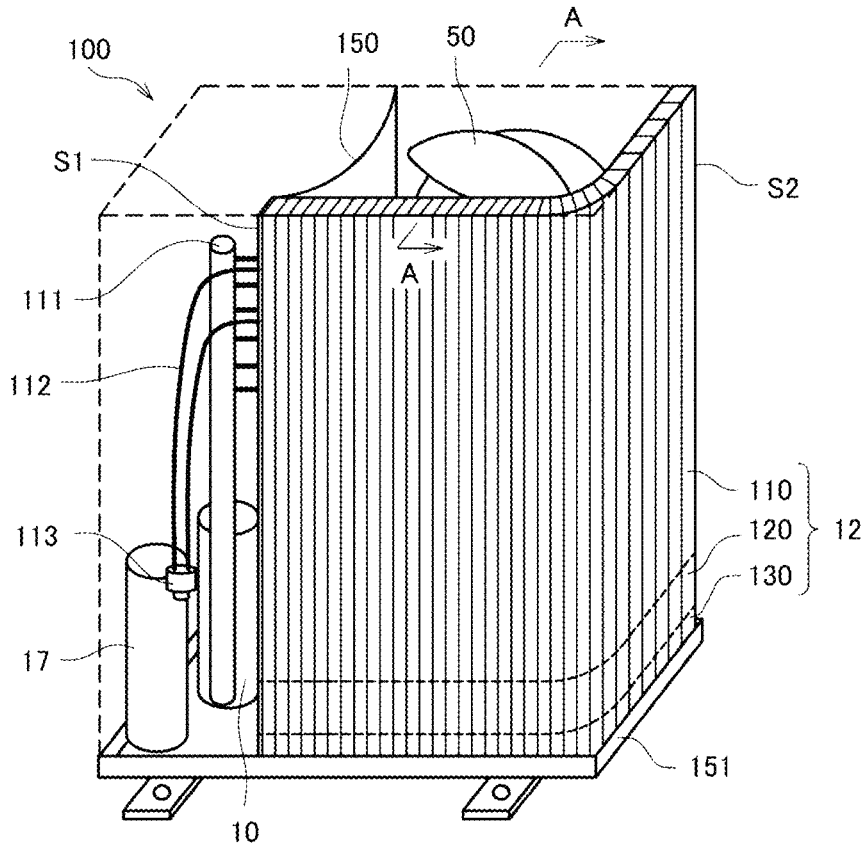
(b)
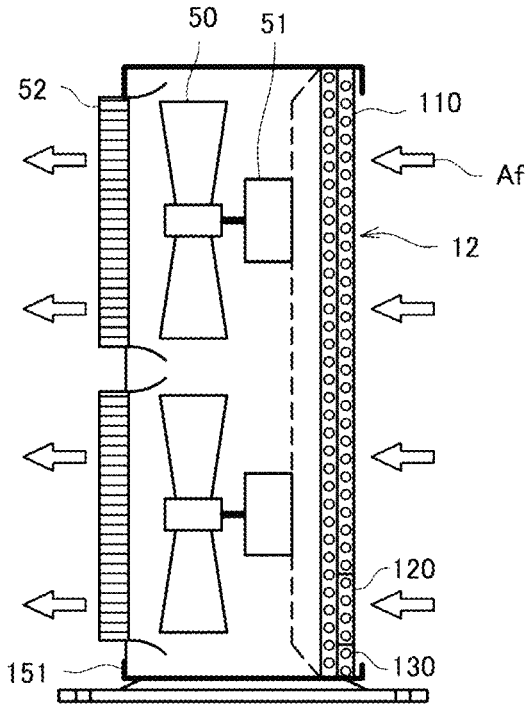

[Fig. 3]
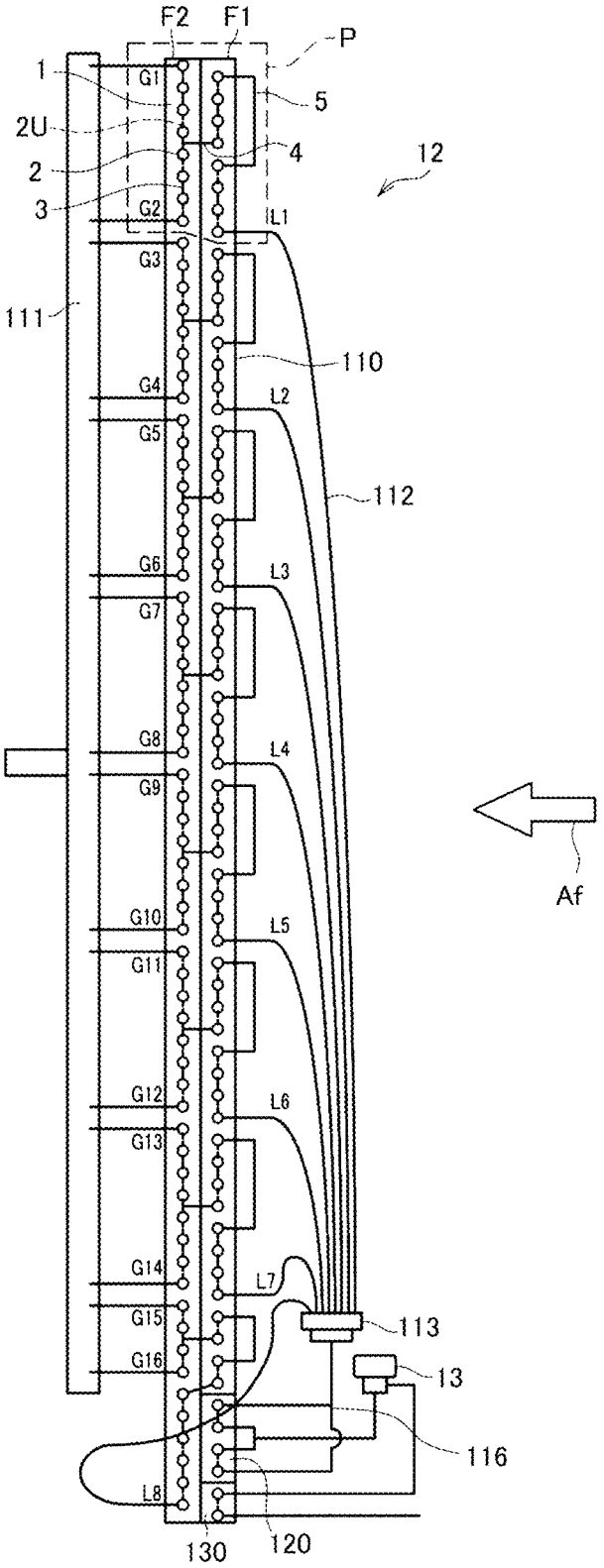

[Fig. 4]
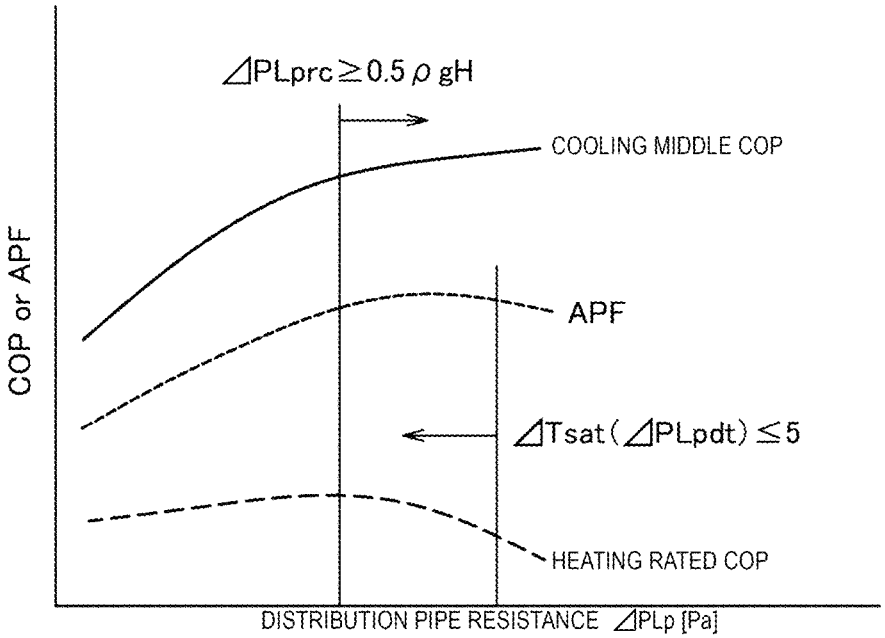
[Fig. 5]
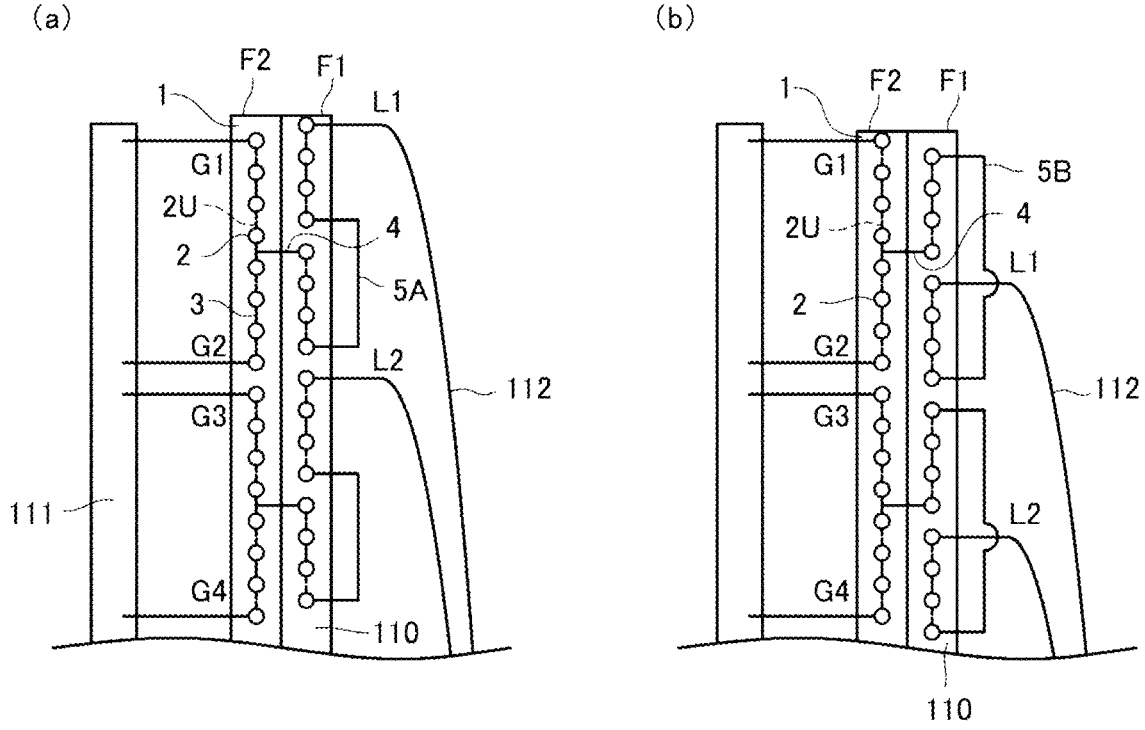

[Fig. 6]
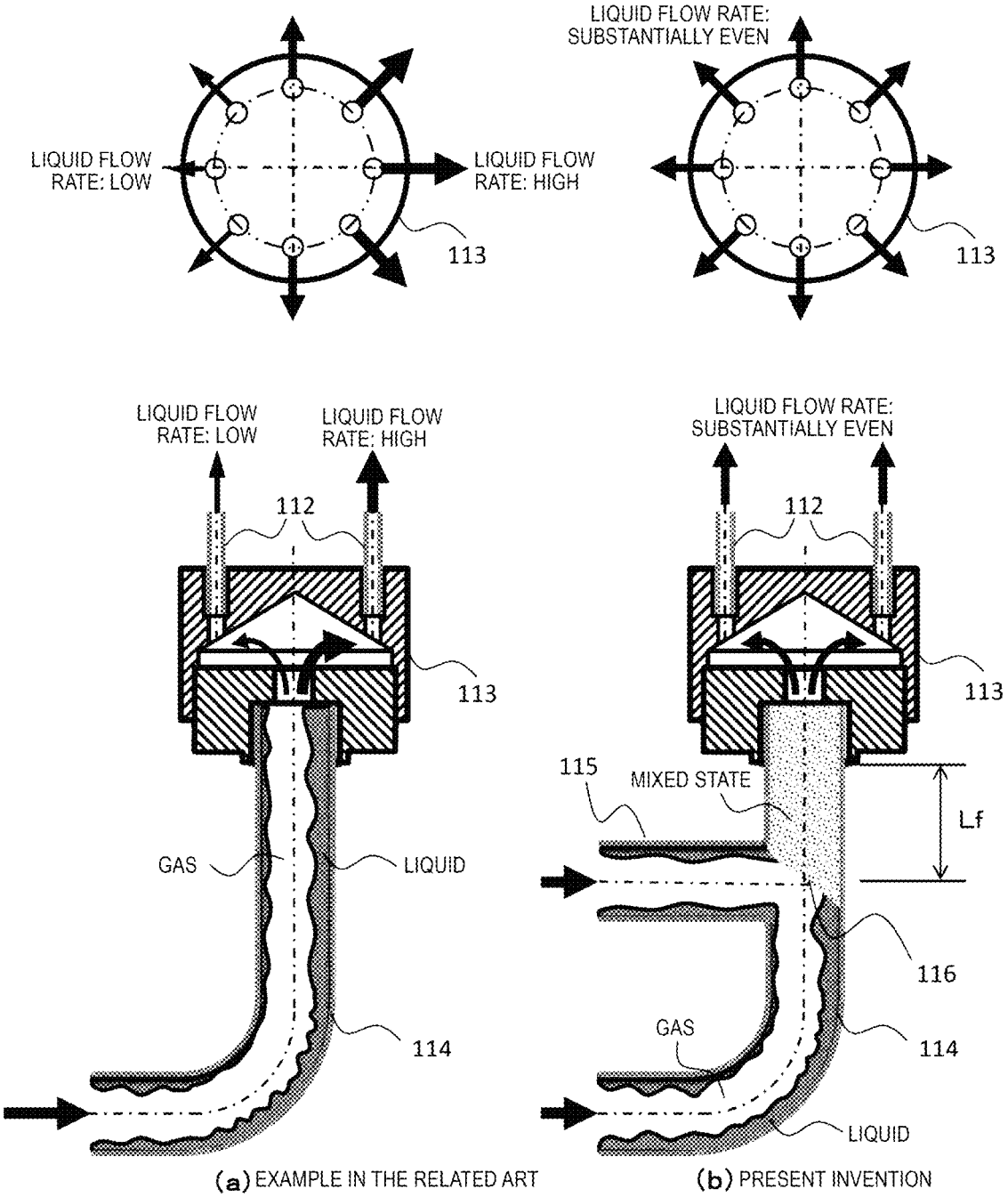
(a) EXAMPLE IN THE RELATED ART (b) PRESENT INVENTION

[Fig. 7]
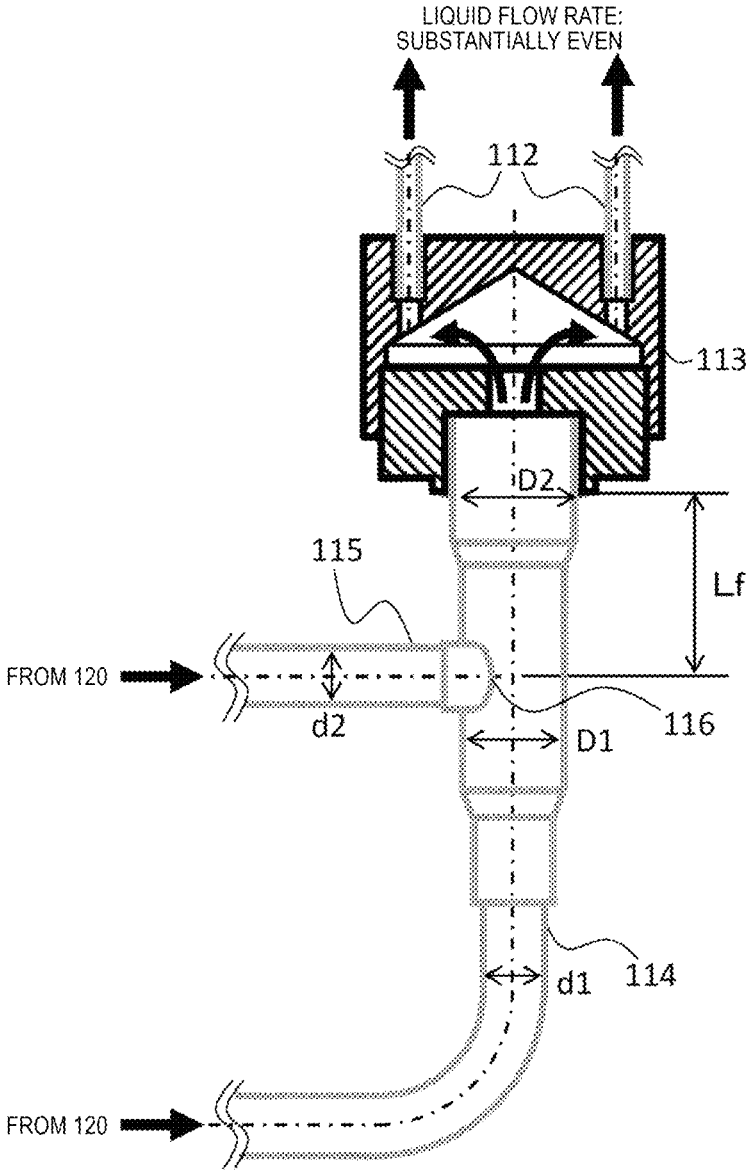

[Fig. 8]
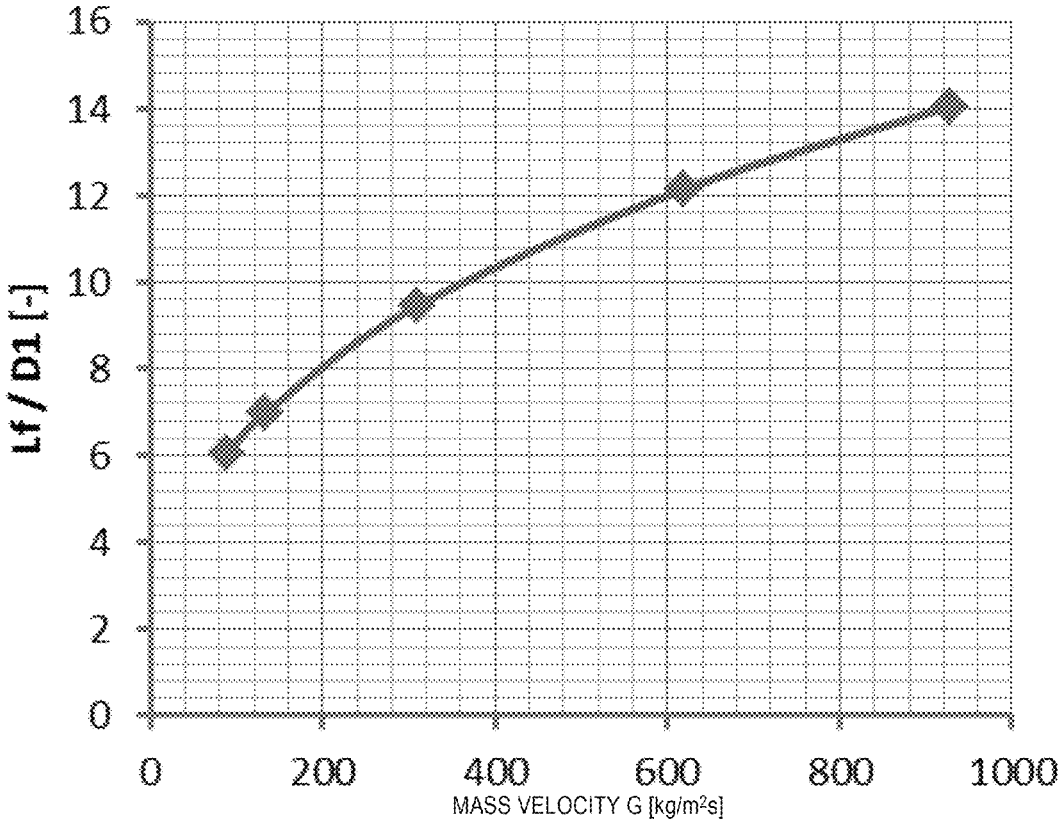

[Fig. 9]
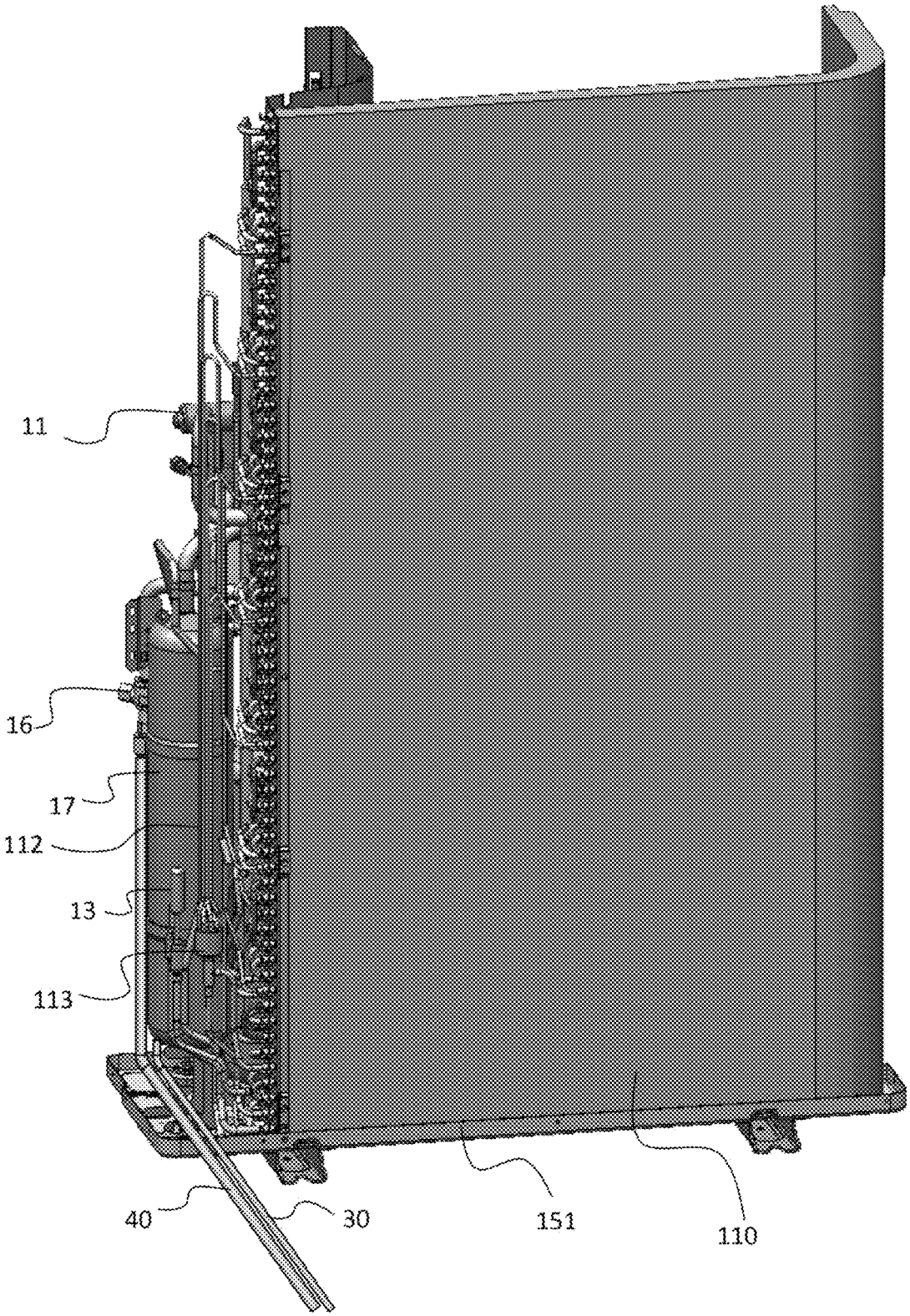

[Fig. 10]
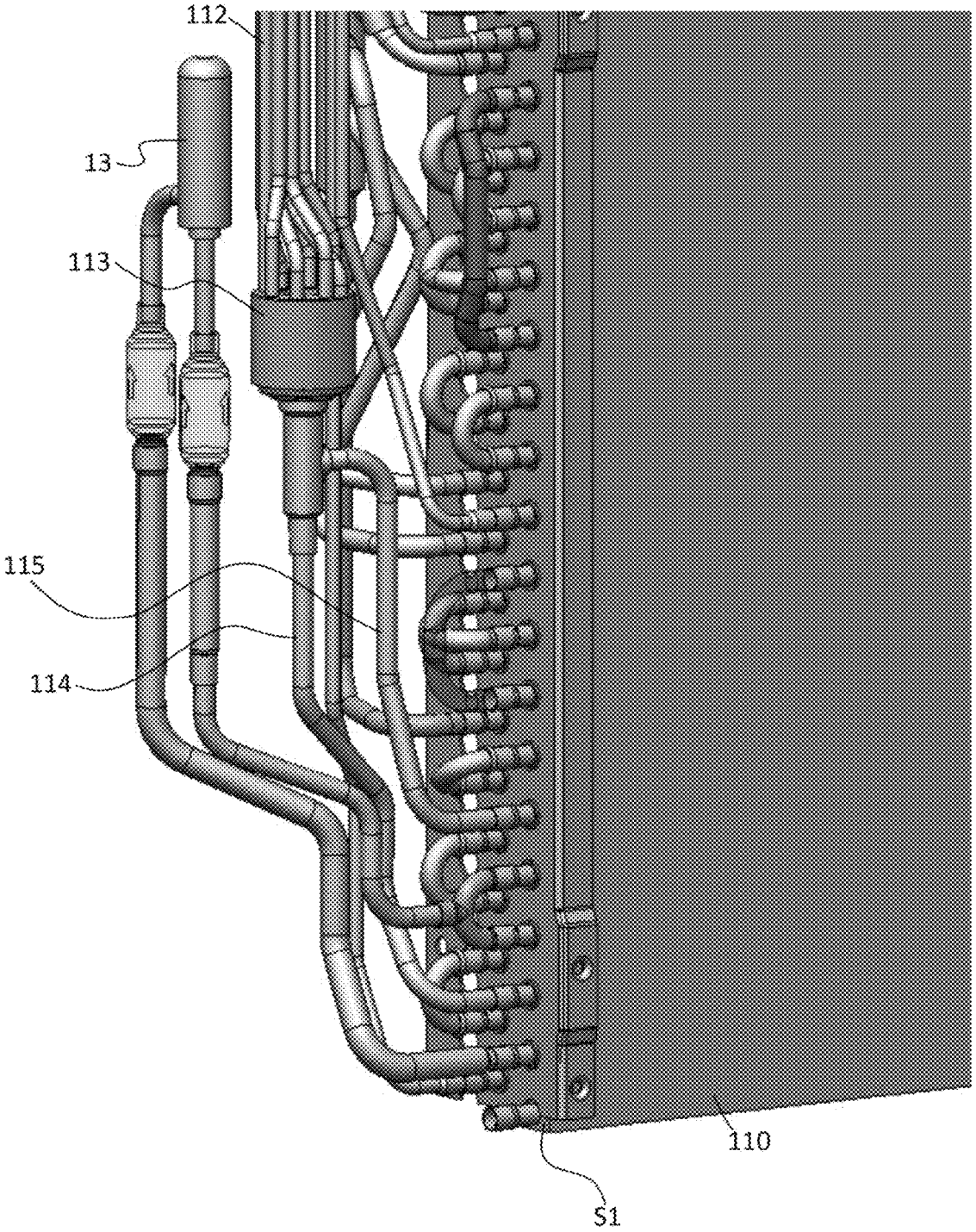

[Fig. 11]
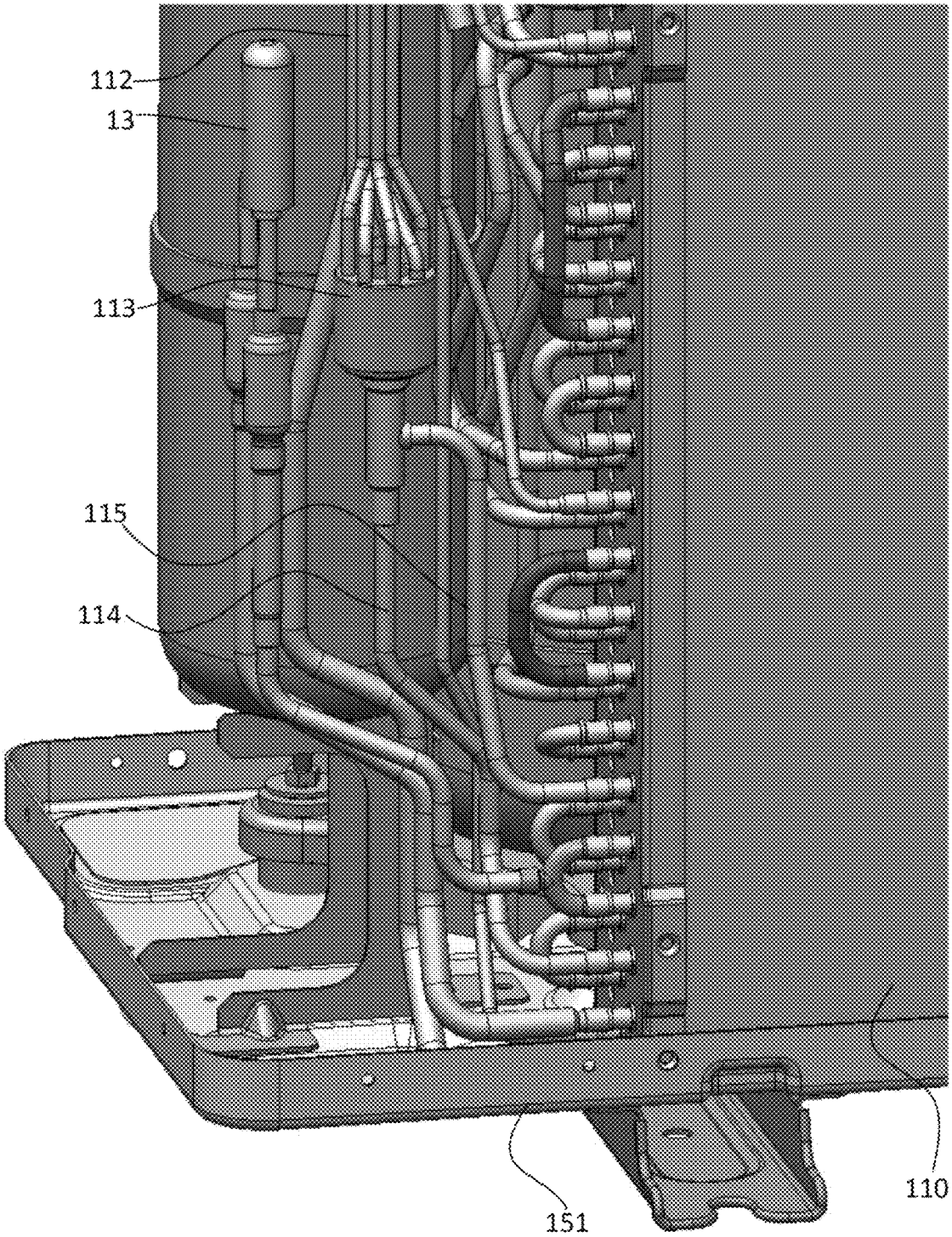

[Fig. 12]
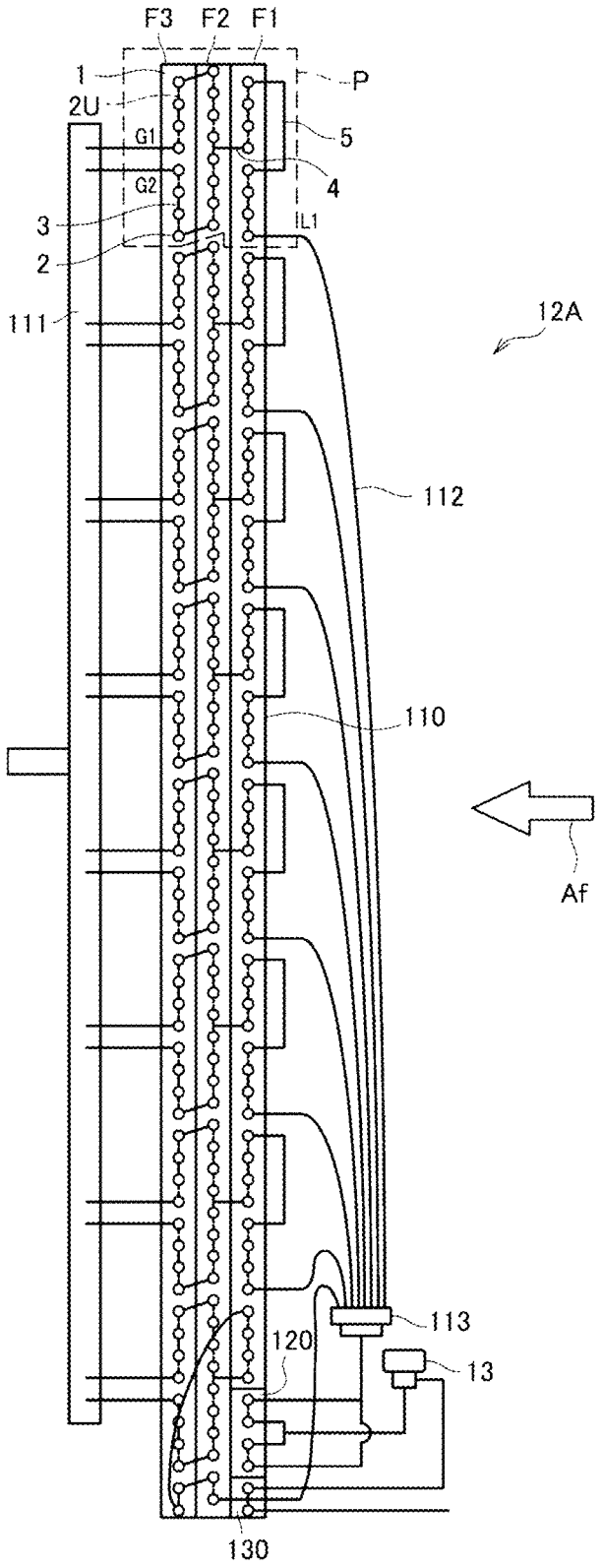

[Fig. 13]
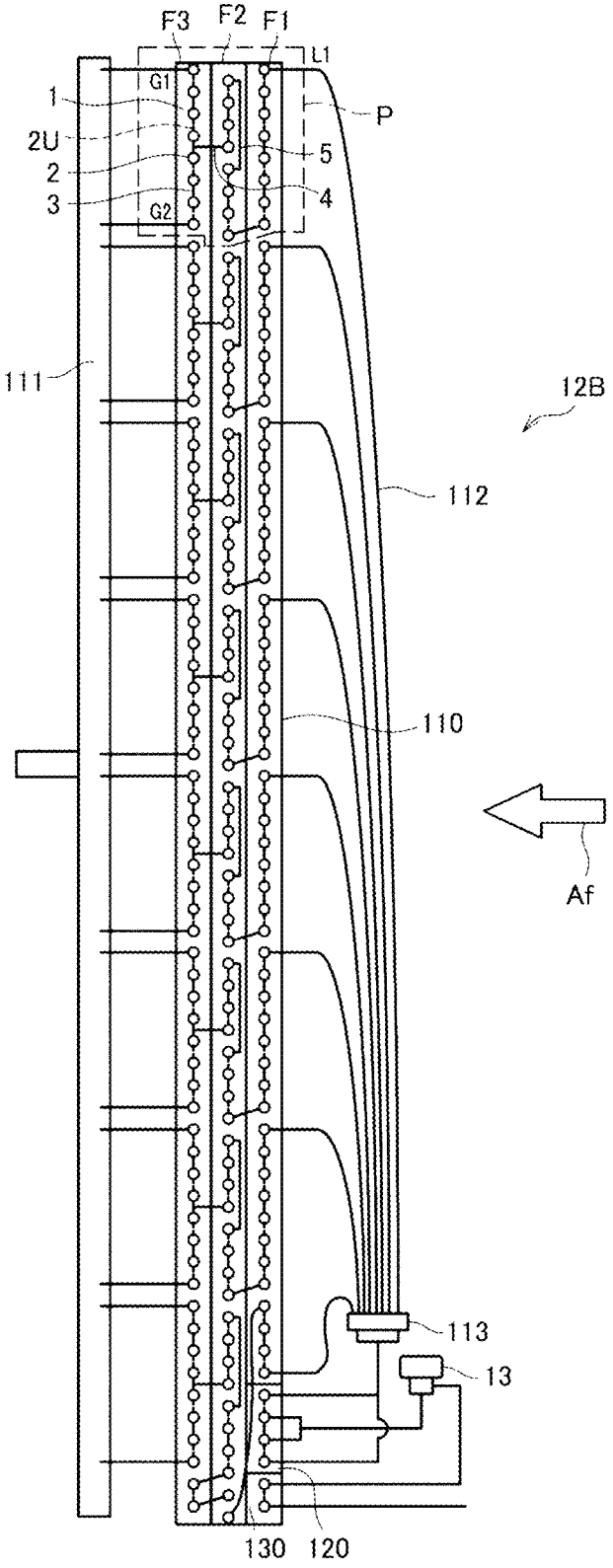

[Fig. 14]
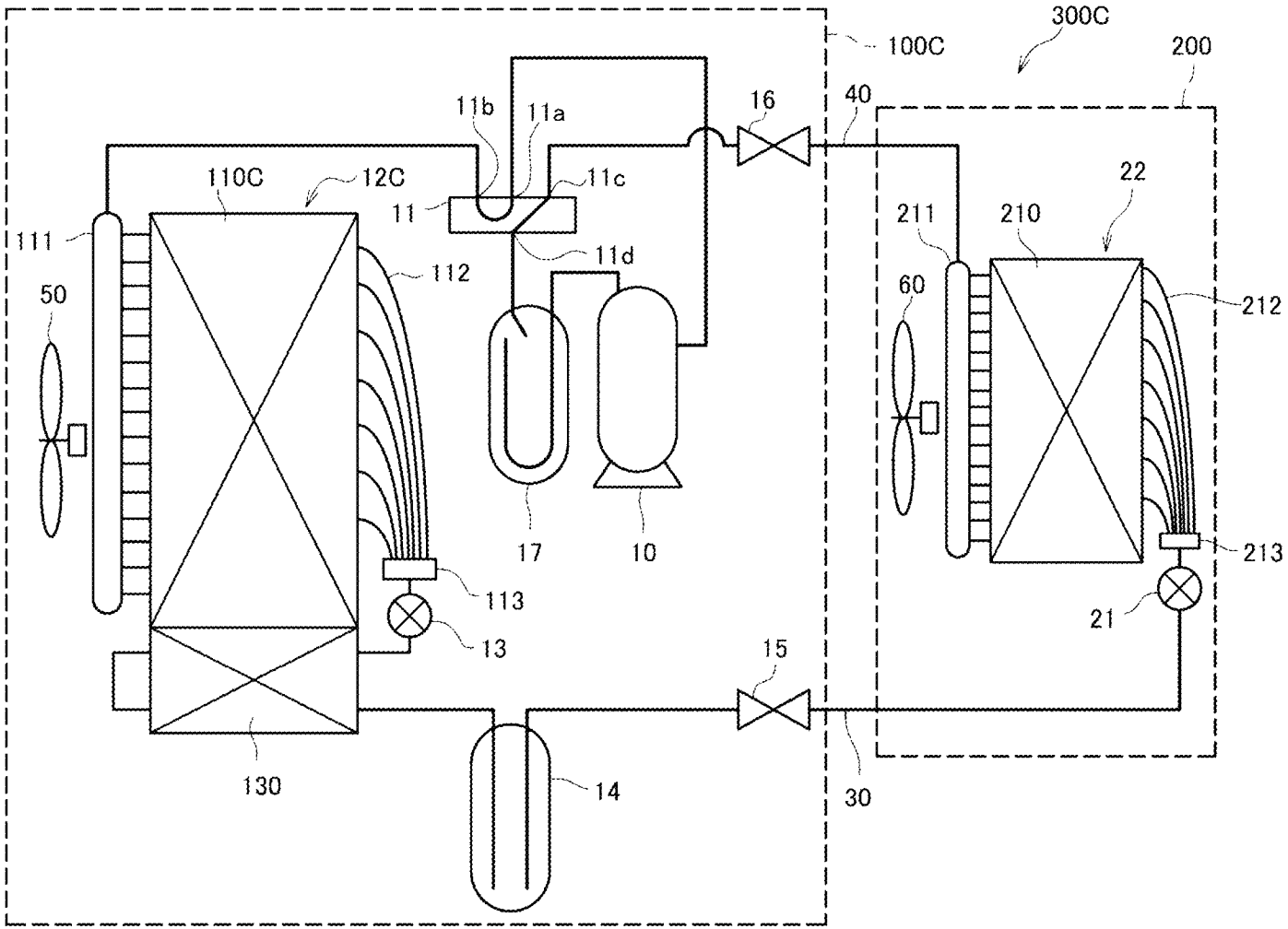

[Fig. 15]
(a)
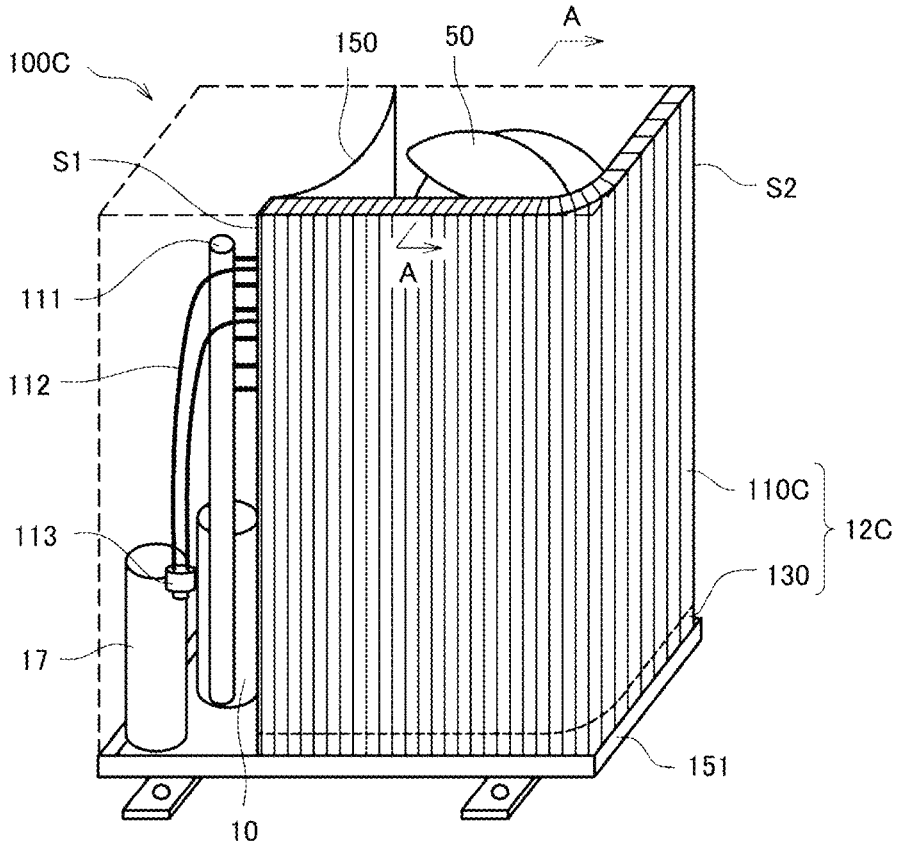
(b)
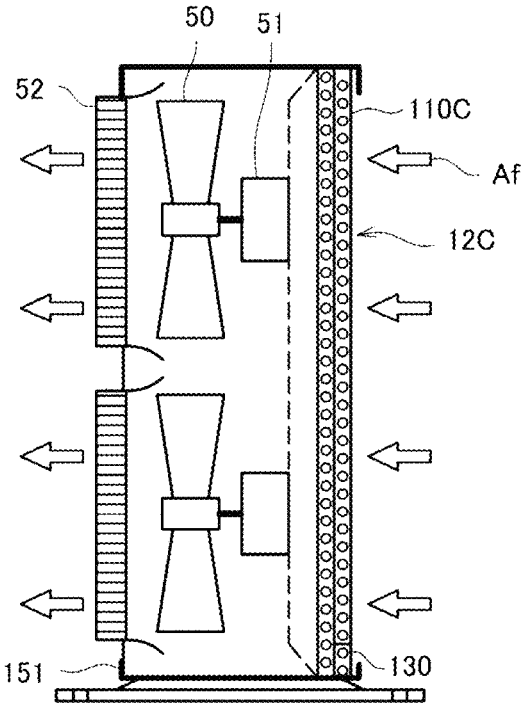

[Fig. 16]
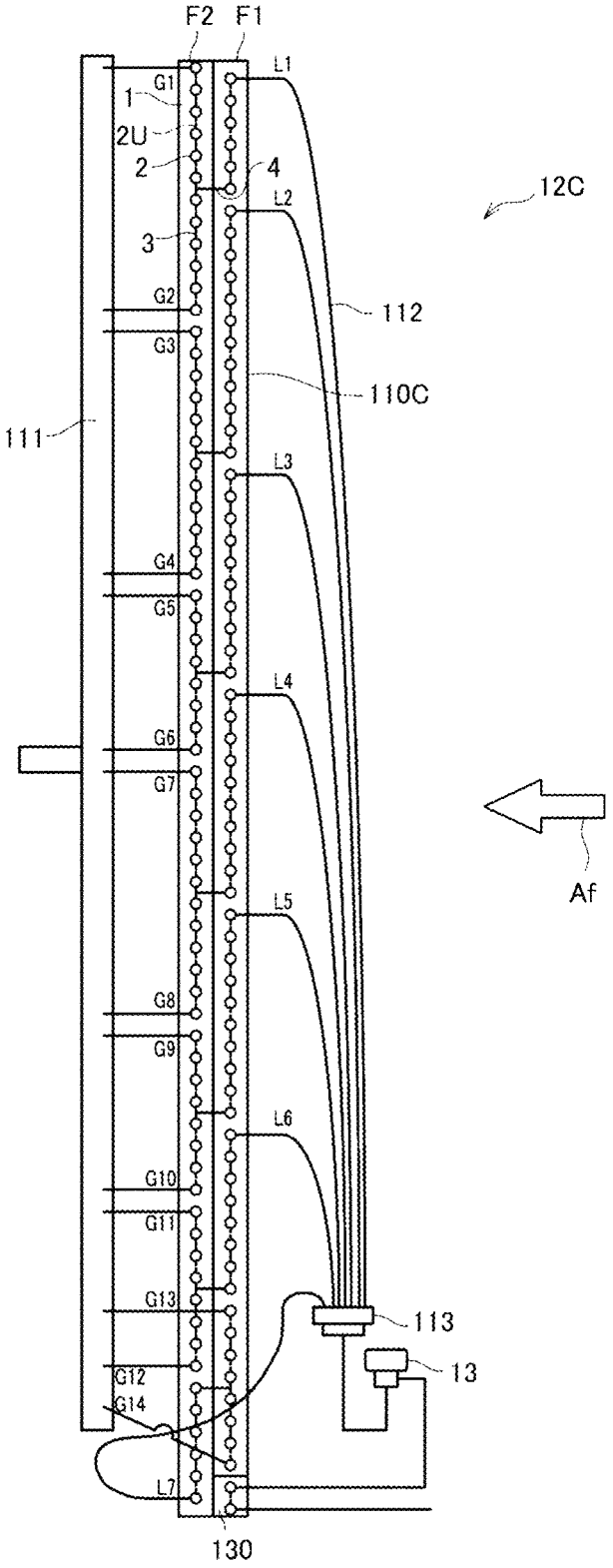

[Fig. 17]
(a) DURING COOLING OPERATION
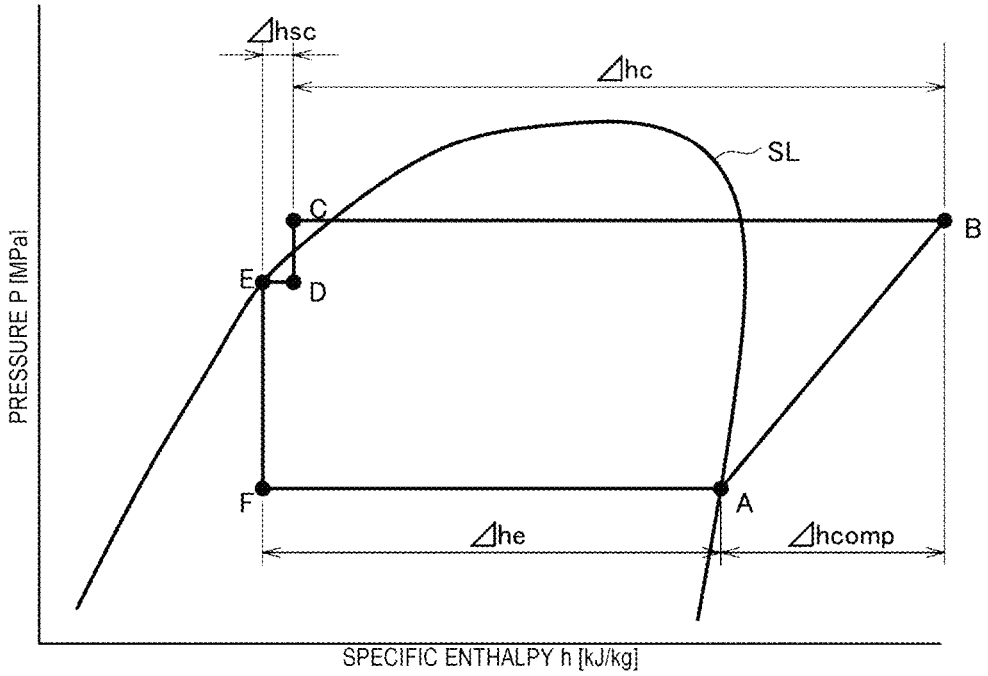
(b) DURING HEATING OPERATION
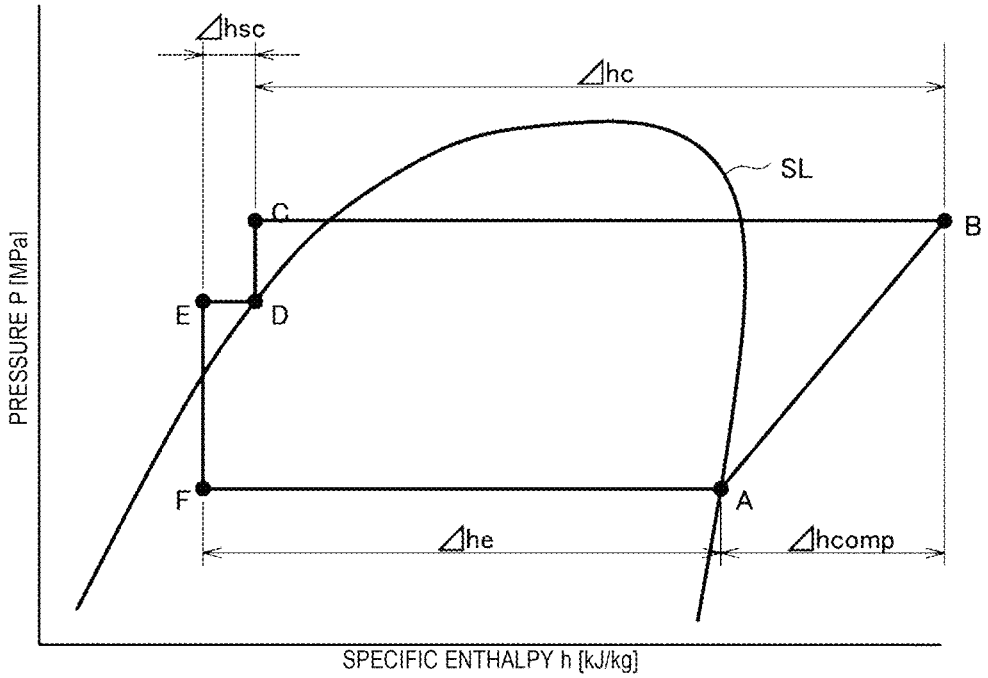

HEAT EXCHANGE APPARATUS AND AIR CONDITIONER USING SAME

TECHNICAL FIELD

The present invention relates to a heat exchange apparatus and an air conditioner using the heat exchange apparatus.

BACKGROUND ART

In the background art of this technical field, in order to evenly distribute gas-liquid two-phase flow on an inlet side of a heat exchanger that functions as an evaporator and to exhibit the maximum performance of a heat exchanger, Patent Literature 1 discloses that, a chamber portion is connected to upstream piping of a distributor so as to be orthogonal thereto, the chamber portion having a diameter larger than that of the upstream piping, and thereby uneven refrigerant distribution improves.

In addition, a heat exchanger disclosed in Patent Literature 2 is a fin and tube type heat exchanger configured to include a heat-transfer pipe having a part configured of four or more paths, in order to reduce degradation of heat exchanger performance of the heat exchanger even in a case where a refrigerant having a significant temperature change during heat release is used, in which paths are configured to have substantially parallel flow of the refrigerant in a stage direction, and, further, refrigerant inlets of the paths are configured to be positioned to be substantially adjacent in a case of being used as a radiator. In this manner, the description is read that it is possible to reduce the degradation of heat exchanging performance, without an increase in draft resistance of an air-side circuit and an increase in manufacturing cost (refer to Abstract).

In addition, Patent Literature 3 is disclosed. In order to provide an air conditioner in which a melted residue of frost is removed and it is possible to realize high-performance heating capacity at a low cost, an air conditioner disclosed in Patent Literature 3 is an air conditioner that includes a refrigeration cycle in which at least a compressor, an indoor heat exchanger, an expansion valve, and an outdoor heat exchanger are connected via a refrigerant circuit, in which the outdoor heat exchanger is configured of a plurality of systems of refrigerant flow paths, any inlets of the plurality of systems of refrigerant flow paths are positioned in a refrigerant flow pipe on the uppermost stage or the second stage from the uppermost stage of the outdoor heat exchanger when the outdoor heat exchanger is used as an evaporator. In this manner, the description is read that it is possible to realize such an air conditioner (refer to Abstract).

PRIOR ART DOCUMENTS

Patent Literatures

Patent Literature 1: Japanese Patent Application Laid-Open No. 2003-121029

Patent Literature 2: Japanese Patent Application Laid-Open No. 2014-20678

Patent Literature 3: Japanese Patent Application Laid-Open No. 2011-145011

SUMMARY OF INVENTION

Technical Problem

In a heat exchanger of an air conditioner, distribution of gas-liquid two-phase flow is optimized in a refrigerant path from which a plurality of paths branch, specific enthalpy of the paths is coincident in an outlet portion of an evaporator, thereby it is possible to use the heat exchanger to the greatest extent, and it is possible to achieve high performance of the heat exchanger.

Patent Literature 1 discloses the distributor and the air conditioner including the distributor that are configured to have a connected chamber structure as means that allows uniform distribution of the gas-liquid two-phase flow in the distributor.

However, in Patent Literature 1, the chamber portions have a specific structure, and thus difficulty in manufacturing the structure causes an increase in costs. In addition, problems arise in that a dimension in a horizontal direction reduces freedom of installation, and, in a case where the structure is applied particularly to a horizontal-blowing type outdoor device, a space needs to be provided in the horizontal direction, thus, a dimension of the heat exchanger is limited, and an increase in performance is not achieved.

In addition, in the heat exchanger of the air conditioner, optimization of a refrigerant flow rate in a heat-transfer pipe enables to maintain good balance between a pressure loss and a heat-transfer coefficient on the refrigerant side, and thus it is possible to increase heat-exchange efficiency. As means thereof, a method in which a plurality of flow paths merge at or branch from an intermediate position of a refrigerant flow path reaching a liquid side from a gas side is known. For example, in the heat exchanger disclosed in Patent Literature 2, refrigerant flow paths merge at an intermediate position when the heat exchanger is used as a condenser. In this manner, the heat-transfer coefficient on the liquid side improves, and the pressure loss on the gas side is reduced when the heat exchanger is used as an evaporator such that high performance of the heat exchanger is achieved.

In addition, when the heat exchanger functions as the condenser, a method, in which a so-called counterflow refrigerant flow path, in which air flows in an inflow direction which is substantially opposite to a flow path direction of the refrigerant, is configured, and thereby an inlet temperature of air approximates to an outlet temperature of the refrigerant such that heat exchange is efficiently performed, has also been known. For example, in the outdoor heat exchanger of the air conditioner disclosed in Patent Literature 2, a flow path using the condenser is configured in a counterflow manner.

However, in a case where both of layout disclosed in Patent Literature 2 in which the refrigerant flow paths merge at an intermediate position and counterflow layout disclosed in Patent Literature 3 are used, freedom of selecting the refrigerant flow paths decreases. Then, either path has to be selected, or a difference is likely to arise between flow-path lengths of the respective refrigerant flow paths. As a result, when optimization is performed on refrigerant distribution for either the case where the heat exchanger functions as the condenser or the case where the heat exchanger functions as the evaporator (in other words, when optimization is performed on the refrigerant distribution for either a cooling operation or a heating operation of the air conditioner), a problem arises in that the refrigerant distribution on the other side is degraded, and thus it is not possible to realize the heat exchange with high efficiency.

In addition, the outdoor heat exchanger of the air conditioner disclosed in Patent Literature 3 includes a subcooler that is disposed on the front side with respect to an air current in the lower portion of the heat exchanger after the liquid sides of the refrigerant flow paths merge. The subcooler enables heat exchange performance to improve when the outdoor heat exchanger functions as the condenser; however, frost or water is likely to remain in the lower portion of the heat exchanger when the outdoor heat exchanger functions as the evaporator, and thus a problem arises in drainage during heating.

An object of the present invention is to provide a heat exchange apparatus and an air conditioner in which an occurrence of uneven refrigerant distribution is reduced such that heat exchange performance of a heat exchanger improves.

Solution to Problem

In order to solve such problems, the heat exchange apparatus or the air conditioner including the heat exchange apparatus according to the present invention is configured to include: a heat-transfer pipe through which a refrigerant flows; a heat exchanger in which a plurality of the heat-transfer pipes are connected to one another and heat exchange between air and the refrigerant is performed; a distributor that distributes the refrigerant to the plurality of heat-transfer pipes; an inflow pipe that causes the refrigerant to flow into the distributor; and a confluent pipe which is connected to an intermediate position of the inflow pipe and in which the refrigerant flowing through an inside thereof is to merge with the refrigerant flowing through an inside of the inflow pipe. A merging part between the inflow pipe and the confluent pipe is positioned in the vicinity of the distributor.

Advantageous Effects of Invention

According to the present invention, an object thereof is to provide the heat exchange apparatus and the air conditioner in which an occurrence of uneven refrigerant distribution is reduced such that heat exchange performance of the heat exchanger improves.

BRIEF DESCRIPTION OF DRAWINGS

FIG. 1 is a diagram schematically illustrating a configuration of an air conditioner according to a first embodiment.

FIG. 2(*a*) is a perspective view illustrating disposition of an outdoor heat exchanger in an outdoor device of the air conditioner according to the first embodiment, and FIG. 2(*b*) is a sectional view taken along line A-A.

FIG. 3 is a layout diagram of refrigerant flow paths in the outdoor heat exchanger of the air conditioner according to the first embodiment.

FIG. 4 is a diagram illustrating an influence of flow-path resistance of a liquid-side distribution pipe on performance.

FIG. 5 is a modification example of the layout diagram of the refrigerant flow paths.

FIG. 6 is a view schematically illustrating comparison between distributor inflow piping according to the first embodiment and piping in the related art.

FIG. 7 illustrates a detailed structure of the distributor inflow piping according to the first embodiment.

FIG. 8 is a graph illustrating a distance between a merging part and a distributor according to the first embodiment.

FIG. 9 is a layout view of connection piping to a rear surface side of the air conditioner according to the first embodiment.

FIG. 10 is an enlarged view on the periphery of the distributor of the air conditioner according to the first embodiment.

FIG. 11 is an enlarged view of a connection piping layout portion on the rear-surface of the air conditioner according to the first embodiment.

FIG. 12 is a layout diagram of refrigerant flow paths in an outdoor heat exchanger of an air conditioner according to a second embodiment.

FIG. 13 is a layout diagram of refrigerant flow paths in an outdoor heat exchanger of an air conditioner according to a third embodiment.

FIG. 14 is a diagram schematically illustrating a configuration of an air conditioner according to a reference example.

FIG. 15(*a*) is a perspective view illustrating disposition of an outdoor heat exchanger in an outdoor device of the air conditioner according to the reference example, and FIG. 15(*b*) is a sectional view taken along line A-A.

FIG. 16 is a layout diagram of refrigerant flow paths in the outdoor heat exchanger of the air conditioner according to the reference example.

FIG. 17 illustrates an operational state of the air conditioner according to the reference example on a Mollier diagram: FIG. 17(*a*) illustrates a state during a cooling operation; and FIG. 17(*b*) illustrates a state during a heating operation.

DESCRIPTION OF EMBODIMENTS

Hereinafter, the present invention will be described with an embodiment in detail with reference to appropriate figures. Note that, in the figures, the same reference signs are assigned to the common portions, and repeated description thereof is omitted.

Reference Example

First, before an air conditioner 300 (refer to FIG. 1 which will be described below) according to the embodiment is described, an air conditioner 300C according to a reference example is described with reference to FIGS. 14 to 17.

FIG. 14 is a diagram schematically illustrating a configuration of the air conditioner 300C according to the reference example.

As illustrated in FIG. 14, the air conditioner 300C according to the reference example includes an outdoor device 100C and an indoor device 200, and the outdoor device 100C and the indoor device 200 are connected via liquid piping 30 and gas piping 40. Note that the indoor device 200 is disposed in an indoor space (in an air-conditioned space) in which air conditioning is performed, and the outdoor device 100C is disposed in an outdoor space.

The outdoor device 100C includes a compressor 10, a four-way valve 11, an outdoor heat exchanger 12C, an outdoor expansion valve 13, a receiver 14, a liquid blocking valve 15, a gas blocking valve 16, an accumulator 17, and an outdoor fan 50. The indoor device 200 includes an indoor expansion valve 21, an indoor heat exchanger 22, and an indoor fan 60.

The four-way valve 11 has four ports 11*a* to 11*d*, the port 11*a* is connected to a discharge side of the compressor 10, the port 11*b* is connected to the outdoor heat exchanger 12C (gas header 111 which will be described below), the port 11*c* is connected to the indoor heat exchanger 22 of the indoor device 200 (gas header 211 which will be described below) via the gas blocking valve 16 and the gas piping 40, and the port 11*d* is connected to a suction side of the compressor 10 via the accumulator 17. In addition, the four-way valve 11 has a configuration in which it is possible to switch communications between the four ports 11*a* to 11*d*. Specifically, during a cooling operation of the air conditioner 300C, as illustrated in FIG. 14, the port 11*a* communicates with the port 11*b*, and the port 11*c* communicates with the port 11*d*. In addition, although not illustrated, during a heating operation of the air conditioner 300C, the port 11*a* communicates with the port 11*c*, and the port 11*b* communicates with the port 11*d*.

The outdoor heat exchanger 12C includes a heat exchanging unit 110C and a subcooler 130 provided under the heat exchanging unit 110C.

The heat exchanging unit 110C is used as a condenser during the cooling operation and is used as an evaporator during the heating operation, in which one side thereof (an upstream side during the cooling operation and a downstream side during the heating operation) in a flowing direction of the refrigerant is connected to the gas header 111 and the other side thereof (a downstream side during the cooling operation and an upstream side during the heating operation) is connected to the outdoor expansion valve 13 via a liquid-side distribution pipe 112 and a distributor 113.

The subcooler 130 is formed below the outdoor heat exchanger 12C, in which one side thereof (the upstream side during the cooling operation and the downstream side during the heating operation) in the flowing direction of the refrigerant is connected to the outdoor expansion valve 13, and the other side thereof (the downstream side during the cooling operation and the upstream side during the heating operation) is connected to the indoor heat exchanger 22 (a distributor 213 which will be described below) of the indoor device 200 via the receiver 14, the liquid blocking valve 15, the liquid piping 30, and the indoor expansion valve 21.

The indoor heat exchanger 22 includes the heat exchanging unit 210. The heat exchanging unit 210 is used as an evaporator during the cooling operation and is used as a condenser during the heating operation, in which one side thereof (the upstream side during the cooling operation and the downstream side during the heating operation) in the flowing direction of the refrigerant is connected to the distributor 213 via a liquid-side distribution pipe 212 and the other side thereof (the downstream side during the cooling operation and the upstream side during the heating operation) is connected to the gas header 211.

Next, actuation of the air conditioner 300C according to the reference example during the cooling operation will be described. During the cooling operation, the four-way valve 11 is switched such that the port 11*a* communicates with the port 11*b*, and the port 11*c* communicates with the port 11*d*.

A high-temperature gas refrigerant discharged from the compressor 10 is sent from the gas header 111 via the four-way valve 11 (ports 11*a* and 11*b*) to the heat exchanging unit 110C of the outdoor heat exchanger 12C. The high-temperature gas refrigerant flowing into the heat exchanging unit 110C is subjected to heat exchanging with outdoor air sent by the outdoor fan 50 and is condensed into a liquid refrigerant. Then, the liquid refrigerant passes through the liquid-side distribution pipe 112, the distributor 113, and the outdoor expansion valve 13, and then is sent to the indoor device 200 via the subcooler 130, the receiver 14, the liquid blocking valve 15, and the liquid piping 30. The liquid refrigerant sent to the indoor device 200 is subjected to pressure reduction in the indoor expansion valve 21, passes through the distributor 213 and the liquid-side distribution pipe 212, and is sent to the heat exchanging unit 210 of the indoor heat exchanger 22. The liquid refrigerant flowing into the heat exchanging unit 210 is subjected to heat exchanging with indoor air sent by the indoor fan 60 and is evaporated into a gas refrigerant. At this time, the indoor air cooled through the heat exchange in the heat exchanging unit 210 is blown indoors by the indoor fan 60 from the indoor device 200 and indoor cooling is performed. Then, the gas refrigerant is sent to the outdoor device 100C via the gas header 211 and the gas piping 40. The gas refrigerant sent to the outdoor device 100C passes through the accumulator 17 through the gas blocking valve 16 and the four-way valve 11 (ports 11*c* and 11*d*) and flows again into and is compressed in the compressor 10.

Next, actuation of the air conditioner 300C according to the reference example during the heating operation will be described. During the heating operation, the four-way valve 11 is switched such that the port 11*a* communicates with the port 11*c*, and the port 11*b* communicates with the port 11*d*.

The high-temperature gas refrigerant discharged from the compressor 10 is sent to the indoor device 200 via the gas blocking valve 16 and the gas piping 40 through the four-way valve 11 (ports 11*a* and 11*d*). The high-temperature gas refrigerant sent to the indoor device 200 is sent from the gas header 211 to the heat exchanging unit 210 of the indoor heat exchanger 22. The high-temperature gas refrigerant flowing into the heat exchanging unit 210 is subjected to heat exchanging with indoor air sent by the indoor fan 60 and is condensed into a liquid refrigerant. At this time, the indoor air cooled through the heat exchange in the heat exchanging unit 210 is blown indoors by the indoor fan 60 from the indoor device 200 and indoor heating is performed.

Then, the liquid refrigerant passes through the liquid-side distribution pipe 212, the distributor 213, and the indoor expansion valve 21, and then is sent to the outdoor device 100C via the liquid piping 30. The liquid refrigerant sent to the outdoor device 100C is subjected to pressure reduction in the outdoor expansion valve 13 through the liquid blocking valve 15, the receiver 14, and the subcooler 130, passes through the distributor 113 and the liquid-side distribution pipe 112, and is sent to the heat exchanging unit 110C of the outdoor heat exchanger 12C. The liquid refrigerant flowing into the heat exchanging unit 110C is subjected to the heat exchanging with the outdoor air sent by the outdoor fan 50 and is evaporated into a gas refrigerant. Then, the gas refrigerant passes through the accumulator 17 through the gas header 111 and the four-way valve 11 (ports 11*b* and 11*d*) and flows again into and is compressed in the compressor 10.

Here, the refrigerant is sealed in a refrigeration cycle and has a function of transmitting heat energy during the cooling operation and the heating operation. Examples of the refrigerant include R410A, R32, a mixed refrigerant containing the R32 and the R1234yf, a mixed refrigerant containing the R32 and the R1234ze (E), and the like. In the following description, a case of using R32 as the refrigerant is described; however, even in a case of using another refrigerant, it is possible to obtain the same action•effects with refrigerant properties such as a pressure loss, a heat-transfer coefficient, and a specific enthalpy, in the following description, and thus detailed description of the case of using another refrigerant is omitted.

Next, an operation state of the air conditioner 300C according to the reference example during the cooling operation will be described. FIG. 17(*a*) is a diagram illustrating the operational state of the air conditioner 300C according to the reference example during the cooling operation on a Mollier diagram.

FIG. 17(*a*) is the Mollier diagram (P-h diagram) in which the vertical axis represents pressure P and the horizontal axis represents specific enthalpy h, a curved line represented by a reference sign SL is a saturation line, and a line from a point A to a point F represents a state change of the refrigerant. Specifically, a line from the point A to a point B represents a compression actuation in the compressor 10, a line from the point B to a point C represents a condensing actuation in the heat exchanging unit 110C of the outdoor heat exchanger 12C functioning as a condenser, a line from the point C to a point D represents a pressure loss through the outdoor expansion valve 13, a line from the point D to a point E represents a heat releasing actuation in the subcooler 130, a line from the point E to a point F represents a pressure reduction actuation in the indoor expansion valve 21, a line from the point F to the point A represents an evaporating actuation in the heat exchanging unit 210 of the indoor heat exchanger 22 that functions as the evaporator, and thus a series of the refrigeration cycle is configured. In addition, Δhcomp represents a specific enthalpy difference produced in the compression power in the compressor 10, Δhc represents a specific enthalpy difference produced during the condensing actuation in the condenser, Δhsc represents a specific enthalpy difference produced during the heat releasing actuation in the subcooler 130, and Δhe represents a specific enthalpy difference produced during the evaporation actuation in the evaporator.

Here, it is possible to express cooling performance Qe [kW] in Expression (1) using the specific enthalpy difference Δhe [kJ/kg] and a refrigerant circulation amount Gr [kg/s] in the evaporator. In addition, it is possible to express a performance coefficient COPe [−] during the cooling operation in Expression (2) using the specific enthalpy difference Δhe [kJ/kg] in the evaporator and the specific enthalpy difference Δhcomp [kJ/kg] produced in the compression power in the compressor 10.

$$Qe=\Delta he\cdot Gr \tag{1}$$

$$\mathrm{COP}e=\Delta he/\Delta h\mathrm{comp} \tag{2}$$

Next, an operation state of the air conditioner 300C according to the reference example during the heating operation will be described. FIG. 17(*b*) is a diagram illustrating the operational state of the air conditioner 300C according to the reference example during the heating operation on a Mollier diagram.

As described above, during the heating operation, compared to the refrigeration cycle state during the cooling operation, the heat exchanging unit 110C of the outdoor heat exchanger 12C and the heat exchanging unit 210 of the indoor heat exchanger 22 are switched over each other to perform actuation as the condenser and the evaporator; however, the other types of actuation are substantially the same.

Specifically, a line from the point A to a point B represents a compression actuation in the compressor 10, a line from the point B to a point C represents a condensing actuation in the heat exchanging unit 210 of the indoor heat exchanger 22 functioning as the condenser, a line from the point C to a point D represents a pressure loss through the indoor expansion valve 21, a line from the point D to a point E represents a heat releasing actuation in the subcooler 130, a line from the point E to a point F represents a pressure reduction actuation in the outdoor expansion valve 13, a line from the point F to the point A represents an evaporating actuation in the heat exchanging unit 110C of the outdoor heat exchanger 12 that functions as the evaporator, and thus a series of the refrigeration cycle is configured.

It is possible to express heating performance Qc [kW] in Expression (3), and it is possible to express the performance coefficient COPc [−] of during the heating operation in Expression (4).

$$Qc=\Delta hc\cdot Gr \tag{3}$$

$$\mathrm{COP}c=\Delta hc/\Delta h\mathrm{comp}=1+\mathrm{COP}e-\Delta hsc/\Delta h\mathrm{comp} \tag{4}$$

During the heating operation, in a case where a temperature of the refrigerant in the subcooler 130 is higher than an outside temperature, a heat release loss occurs with respect to the outside air. Therefore, in order to maintain the high performance coefficient COPc during the heating operation, it is necessary to reduce a heat release amount in the subcooler 130 to the smallest extent (that is, to reduce Δhsc). On the other hand, as illustrated in FIG. 14, the subcooler 130 is disposed under the heat exchanging unit 110C of the outdoor heat exchanger 12C, and thus an antifreezing effect of a drain pan or an effect of accumulation prevention of frost is achieved during the heating operation.

In addition, as illustrated by comparing FIG. 17(*a*) to FIG. 17(*b*), the refrigerant has a higher pressure and a lower flow rate when the heat exchanging unit 110C of the outdoor heat exchanger 12C is used as the condenser (between B to C in FIG. 17(*a*)) than when the heat exchanging unit 110C of the outdoor heat exchanger 12C is used as the evaporator (between F to A in FIG. 17(*b*)). Therefore, the pressure loss is relatively reduced, and a surface heat-transfer coefficient is reduced. Therefore, in the air conditioner 300C that switches between the cooling operation and the heating operation, the number of branching flow paths of the heat exchanging unit 110C is set such that a refrigerant circulation amount per flow path of the heat exchanging unit 110C strikes balance between both of the cooling and the heating.

<Outdoor Heat Exchanger 12C>

As described above, in order to achieve high efficiency of the heat exchanger, a method of merging or branching of the refrigerant flow paths at an intermediate position through the heat exchanger is employed. A configuration of the outdoor heat exchanger 12C of the air conditioner 300C according to the reference example is redescribed with reference to FIGS. 15 and 16. FIG. 15(*a*) is a perspective view illustrating disposition of the outdoor heat exchanger 12C in the outdoor device 100C of the air conditioner 300C according to the reference example, and FIG. 15(*b*) is a sectional view taken along line A-A.

As illustrated in FIG. 15(*a*), the inside of the outdoor device 100C is partitioned by a partition plate 150, the outdoor heat exchanger 12C, the outdoor fan 50, and the outdoor fan motor 51 (refer to FIG. 15(*b*)) are disposed in one chamber (on the right side in FIG. 15(*a*)), and the compressor 10, the accumulator 17, and the like are disposed in the other chamber (on the left side in FIG. 15(*a*)).

The outdoor heat exchanger 12C is mounted on the drain pan 151 and is disposed to be bent to form an L shape along two sides of a housing. In addition, as illustrated in FIG. 15(*b*), arrow Af represents flow of outdoor air. The outdoor air Af suctioned into the inside of the outdoor device 100C by the outdoor fan 50 passes through the outdoor heat exchanger 12C and is discharged to the outside of the outdoor device 100C from a vent 52.

FIG. 16 is a layout diagram of refrigerant flow paths in the outdoor heat exchanger 12C of the air conditioner 300C according to the reference example. FIG. 16 is a diagram obtained when viewing one end side S1 (refer to FIG. 15(*a*)) of the outdoor heat exchanger 12C.

The outdoor heat exchanger 12C is configured to include a fin 1, heat-transfer pipes 2 that have a turning portion 2U and are arranged along both ways in the horizontal direction, U-bends 3, and three-way bents 4 as merging parts of the refrigerant flow paths. In addition, FIG. 16 illustrates a case where the outdoor heat exchanger 12C is configured to have two rows (a first row F1 and a second row F2) of the heat-transfer pipes 2 arranged in a flowing direction of the outdoor air Af. In addition, the heat-transfer pipes 2 have a zigzag arrangement with the first row F1 and the second row F2. In addition, as illustrated in FIG. 16, when the heat exchanging unit 110C of the outdoor heat exchanger 12C is used as the condenser (that is, during the cooling operation of the air conditioner 300C) with respect to the flow of the outdoor air Af that flows from right to left, the flow of the refrigerant is from left (the gas header 111 side) to right (the distributor 113 side) and thus the flows become pseudo counterflow.

When the heat exchanging unit 110C of the outdoor heat exchanger 12C is used as the condenser (that is, during the cooling operation of the air conditioner 300C), gas refrigerants that flow in from gas-side inlets G1 and G2 of the second row F2 circulate through the heat-transfer pipe 2 while flowing along both ways in the horizontal direction between the one end portion S1 (refer to FIG. 15(*a*)) and the other end portion S2 (refer to FIG. 15(*a*)) of the outdoor heat exchanger 12C which is bent to have the L shape.

At this time, the refrigerant flow path has a configuration in which one end portion of the heat-transfer pipe 2 and one end portion of another heat-transfer pipe 2 adjacent in the same row (second row F2) are connected in the one end portion S1 (refer to FIG. 15(*a*)) by brazing the U-bend 3 that is bent to have the U shape. In addition, in the other end portion S2 (refer to FIG. 15(*a*)), the refrigerant flow path is configured to have the turning portion 2U (illustrated in a dashed line in FIG. 16) having a structure in which the heat-transfer pipe 2 is bent to form a hair-pin shape such that no brazed portions are formed.

In this manner, the gas refrigerants that flow in from the gas-side inlets G1 and G2 flow in directions (in a downward direction by the refrigerant from the gas-side inlet G1 and in an upward direction by the refrigerant from the gas-side inlet G2) in which the refrigerants approach each other in a vertical direction while flowing along both ways through the heat-transfer pipes 2 in the horizontal direction, and reach positions which are adjacent to each other up and down. Then, the refrigerants merge in the three-way bend 4 and flow to the heat-transfer pipe 2 of the first row F1 positioned on the upstream side of the outdoor air Af. The three-way bend 4 connects, by brazing, end portions of the two heat-transfer pipes 2 of the second row F2 to one end portion of one heat-transfer pipe 2 of the first row F1, and a merging part of the refrigerant flow paths is formed.

The refrigerant that flows into the heat-transfer pipe 2 of the first row F1 from the three-way bend 4 flows upward to the liquid-side distribution pipe 112 through a liquid-side outlet L1 while flowing along both ways in the heat-transfer pipe 2 in the horizontal direction. In the following description, a refrigerant flow path from the two gas-side inlets (G1 and G2) from which flowing-in is performed, through the three-way bend 4 in which merging is performed, to one liquid-side outlet (L1) from which flowing-out is performed, is referred to as a "path". The liquid refrigerant that flows to the liquid-side distribution pipe 112 and another liquid refrigerant from another path in the distributor 113 merge, reach the outdoor expansion valve 13 and the subcooler 130, and circulate to the receiver 14.

Here, as illustrated in FIG. 16, a refrigerant flow path from gas-side inlets G3 and G4 to a liquid-side outlet L2 is longer in a refrigerant flow path in the first flow F1 on the liquid side, compared to the refrigerant flow path from the gas-side inlets G1 and G2 to the liquid-side outlet L1. In addition, a refrigerant flow path from gas-side inlets G5 and G6 to a liquid-side outlet L3 is shorter in a refrigerant flow path in the second flow F2 on the gas side, compared to the refrigerant flow path from the gas-side inlets G1 and G2 to the liquid-side outlet L1.

In this manner, in the outdoor heat exchanger 12C (heat exchanging unit 110C) of the air conditioner 300C according to the reference example, in a case where the counterflow arrangement and the merging at an intermediate position are both performed, a problem arises in that it is difficult to have equal lengths of the refrigerant flow paths in the paths. Therefore, it is not possible to set optimal refrigerant distribution in both of the cooling operation and the heating operation, and, in a case where the flow-path resistance of the liquid-side distribution pipe 112 is set to have equal outlet specific enthalpy of one operation (for example, the heating operation), it is likely to have a difference between respective refrigerant flow paths in the paths in specific enthalpy (a temperature or a degree of dryness of the refrigerant) of the other operation (for example, the cooling operation). As a result, effects of the outdoor heat exchanger 12C (the heat exchanging unit 110C) are reduced.

In addition, as described above, in order to maintain the high performance coefficient COPc during the heating operation, it is desirable to reduce the heat release amount in the subcooler 130 to the smallest extent. Therefore, the subcooler 130 is disposed in the first row F1 on the upstream side in the flowing direction of the outdoor air Af, a liquid-side outlet L7 is disposed at a position in the second row F2 on the downstream side, which corresponds to a position at which the subcooler 130 is disposed, and thus heat energy released from the subcooler 130 is efficiently collected through a path flowing from the liquid-side outlet L7 to gas-side inlets G13 and G14.

However, in the outdoor heat exchanger 12C (heat exchanging unit 110C) of the air conditioner 300C according to the reference example illustrated in FIG. 16, since the lowermost path (path flowing from the gas-side inlets G13 and G14 to the liquid-side outlet L7) is not disposed in a counterflow manner, during the heating operation, there is a problem of improving cooling performance.

Further, as described above, in the heating operation, the subcooler 130 collects the heat energy released in the heat exchanging unit on the lower side of the blowing; however, it is not possible to collect all of the energy, and thus the operation has to be limited to the smallest region.

Therefore, an effect of improvement in condensing performance obtained by increasing the flow rate in the heat-transfer pipe during the cooling operation and increasing a refrigerant heat-transfer coefficient is limited. In other words, problems arise in that an area ratio of the subcooler 130 has a trade-off relationship between the heating performance and the cooling performance, and it is not possible to exhibit the maximum performance of both operations.

In addition, the gas-liquid two-phase refrigerant, of which pressure is reduced in the outdoor expansion valve 13 during the heating operation, flows to the distributor 113 in a state in which the liquid refrigerant unevenly gathers in refrigerant passages. In particular, in a case of the configuration illustrated in FIG. 16, since a bent pipe portion is provided in a piping route from the outdoor expansion valve 13 to the distributor 113, the liquid refrigerant unevenly gathered due to the centrifugal force produced in the bent pipe portion flows to the distributor 113.

Therefore, when the refrigerant flows to the distributor 113, then is distributed to a plurality of refrigerant passages, problems arise in that degrees of dryness are uneven in the passages, variations in the specific enthalpy are produced in the outlet of the heat exchanger functioning as the evaporator, and thus it is not possible to efficiently use the heat exchanger.

First Embodiment

Next, the air conditioner 300 according to a first embodiment will be described with reference to FIGS. 1 to 4. FIG. 1 is a diagram schematically illustrating a configuration of the air conditioner 300 according to the first embodiment. FIG. 2(*a*) is a perspective view illustrating disposition of an outdoor heat exchanger 12 in an outdoor device 100 of the air conditioner 300 according to the first embodiment, and FIG. 2(*b*) is a sectional view taken along line A-A.

The air conditioner 300 (refer to FIGS. 1 and 2) according to the first embodiment has a different configuration of the outdoor device 100, compared to the air conditioner 300C (refer to FIGS. 14 and 15) according to the reference example. Specifically, there is a difference in that the outdoor device 100C of the reference example includes the outdoor heat exchanger 12C that is provided with the heat exchanging unit 110C and the subcooler 130, but the outdoor device 100 of the first embodiment includes the outdoor heat exchanger 12 that is provided with a heat exchanging unit 110, a subcooler 120, and the subcooler 130. The other configuration is the same, and the repeated description thereof is omitted.

The outdoor heat exchanger 12 includes the heat exchanging unit 110, the subcooler 120 provided under the heat exchanging unit 110, and the subcooler 130 provided under the subcooler 120.

The heat exchanging unit 110 is used as the condenser during the cooling operation and is used as the evaporator during the heating operation, in which one side thereof (the upstream side during the cooling operation and the downstream side during the heating operation) in the flowing direction of the refrigerant is connected to the gas header 111, and the other side thereof (the downstream side during the cooling operation and the upstream side during the heating operation) is connected to the distributor 113 via the liquid-side distribution pipe 112.

The subcooler 120 is formed below the outdoor heat exchanger 12 and above the subcooler 130, in which one side thereof (the upstream side during the cooling operation and the downstream side during the heating operation) in the flowing direction of the refrigerant is connected to the distributor 113, and the other side thereof (the downstream side during the cooling operation and the upstream side during the heating operation) is connected to the outdoor expansion valve 13.

The subcooler 130 is formed below the subcooler 120 under the outdoor heat exchanger 12, in which one side thereof (the upstream side during the cooling operation and the downstream side during the heating operation) in the flowing direction of the refrigerant is connected to the outdoor expansion valve 13, and the other side thereof (the downstream side during the cooling operation and the upstream side during the heating operation) is connected to the indoor heat exchanger 22 (the distributor 213 which will be described below) of the indoor device 200 via the receiver 14, the liquid blocking valve 15, the liquid piping 30, and the indoor expansion valve 21.

In such a configuration, during the cooling operation of the air conditioner 300, the high-temperature gas refrigerant flowing into the heat exchanging unit 110 from the gas header 111 is subjected to the heat exchanging with outdoor air sent by the outdoor fan 50 and is condensed into the liquid refrigerant. Then, the liquid refrigerant passes through the liquid-side distribution pipe 112, the distributor 113, the subcooler 120, and the outdoor expansion valve 13, and then is sent to the indoor device 200 via the subcooler 130, the receiver 14, the liquid blocking valve 15, and the liquid piping 30.

In addition, during the heating operation of the air conditioner 300, the liquid refrigerant sent to the outdoor device 100 from the indoor device 200 via the liquid piping 30 is subjected to pressure reduction in the outdoor expansion valve 13 through the liquid blocking valve 15, the receiver 14, and the subcooler 130, passes through the subcooler 120, the distributor 113, and the liquid-side distribution pipe 112, and is sent to the heat exchanging unit 110 of the outdoor heat exchanger 12C. The liquid refrigerant flowing into the heat exchanging unit 110 is subjected to the heat exchanging with the outdoor air sent by the outdoor fan 50, is evaporated into a gas refrigerant, and is sent to the gas header 111.

<Outdoor Heat Exchanger 12>

A configuration of the outdoor heat exchanger 12 of the air conditioner 300 according to the first embodiment is redescribed with reference to FIG. 3. FIG. 3 is a layout diagram of refrigerant flow paths in the outdoor heat exchanger 12 of the air conditioner 300 according to the first embodiment. FIG. 3 is a diagram obtained when viewing one end side S1 (refer to FIG. 2(*a*)) of the outdoor heat exchanger 12.

The outdoor heat exchanger 12 is configured to include a fin 1, the heat-transfer pipes 2 that have the turning portion 2U and are arranged along both ways in the horizontal direction, U-bends 3, three-way bents 4 as merging parts of the refrigerant flow paths, and the connection pipes 5. Similar to the outdoor heat exchanger 12C (refer to FIG. 16) of the reference example, the outdoor heat exchanger 12 has a configuration in which two rows (first row F1 and second row F2) of the heat-transfer pipes 2 are arranged, and the heat-transfer pipes 2 have zigzag arrangement having the first row F1 and the second row F2. In the configuration, the flow of the refrigerant and the flow of the outdoor air Af are pseudo counterflow when the heat exchanging unit 110 of the outdoor heat exchanger 12 is used as the condenser (that is, during the cooling operation of the air conditioner 300).

Flow of the refrigerant in the first path (path flowing from the gas-side inlets G1 and G2 to the liquid-side outlet L1) of the outdoor heat exchanger 12 (heat exchanging unit 110) is described. The gas refrigerants that flow in from the gas-side inlets G1 and G2 flow in directions (in a downward direction by the refrigerant from the gas-side inlet G1 and in an upward direction by the refrigerant from the gas-side inlet G2) in which the refrigerants approach each other in a vertical direction while flowing along both ways through the heat-transfer pipes 2 in the horizontal direction, and reach positions which are adjacent to each other up and down. Then, the refrigerants merge in the three-way bend 4 and flow to the heat-transfer pipe 2 of the first row F1 positioned on the upstream side of the outdoor air Af.

The refrigerant that flows into the heat-transfer pipe 2 of the first row F1 from the three-way bend 4 flows upward while flowing along both ways through the heat-transfer pipe 2 in the horizontal direction, and flows through the connection pipe 5 at the same stage as the gas-side inlet G1 (a position lower than the gas-side inlet G1 by a half pitch, since the heat-transfer pipes 2 have the zigzag arrangement in the first row F1 and the second row F2) to a heat-transfer pipe 2 which is immediately below the heat-transfer pipe 2 of the first row F1 that is connected to the three-way bend 4. The connection pipe 5 connects, by brazing, one end of the heat-transfer pipe 2 in the first row F1 in the same stage as the gas-side inlet G1 to one end of the heat-transfer pipe 2 which is immediately below the heat-transfer pipe 2 of the first row F1 that is connected to the three-way bend 4 and configures a refrigerant flow path.

The refrigerant that flows into the heat-transfer pipe 2 from the connection pipe 5 flows downward while flowing along both ways through the heat-transfer pipe 2 in the horizontal direction, and flows to the liquid-side distribution pipe 112 in the liquid-side outlet L1 at the same stage as the gas-side inlet G2 (a position lower than the gas-side inlet G2 by a half pitch, since the heat-transfer pipes 2 have the zigzag arrangement in the first row F1 and the second row F2).

In other words, the number of times of arrangement of the heat-transfer pipe 2 along both ways from the gas-side inlet G1 to the three-way bent 4 in the horizontal direction, the number of times of arrangement of the heat-transfer pipe 2 along both ways from the gas-side inlet G2 to the three-way bent 4 in the horizontal direction, the number of times of arrangement of the heat-transfer pipe 2 along both ways from the three-way bent 4 to the connection pipe 5 in the horizontal direction, and the number of times of arrangement of the heat-transfer pipe 2 along both ways from the connection pipe 5 to the liquid-side outlet L1 in the horizontal direction are all equal.

Then, the liquid refrigerant that flows to the liquid-side distribution pipe 112 and another liquid refrigerant from another path in the distributor 113 merge, reach the subcooler 120, the outdoor expansion valve 13 and the subcooler 130, and circulate to the receiver 14.

The second path (path flowing from the gas-side inlets G3 and G4 to the liquid-side outlet L2) of the outdoor heat exchanger 12 is the same refrigerant flow path as the first path (path flowing from the gas-side inlets G1 and G2 to the liquid-side outlet L1). The same is true of the following paths, and the outdoor heat exchanger 12 (heat exchanging unit 110) includes a plurality of (seven in an example in FIG. 3) the refrigerant flow paths which are the same as in the first path.

In such a configuration, in the outdoor heat exchanger (heat exchanging unit 110) of the air conditioner 300 according to the first embodiment, it is possible to have both of the counterflow arrangement and the merging at an intermediate position, and thus it is possible to have equal lengths of the refrigerant flow paths in the paths. In this manner, it is possible to set the flow-path resistance of the liquid-side distribution pipe 112 so as to achieve the optimal refrigerant distribution in both of the cooling operation and the heating operation.

In other words, in the heating operation, when the flow-path resistance of the liquid-side distribution pipe 112 is set depending on the outlet specific enthalpy, it is not necessary to have a difference between the flow-path resistances in the liquid-side distribution pipes 112 in the path since the refrigerant flow paths in the paths are the same. Therefore, in the cooling operation, a difference is prevented from occurring between values of the specific enthalpy (temperatures or degrees of dryness of the refrigerants) of the refrigerant flow paths in the paths due to the difference between the flow-path resistances of the liquid-side distribution pipes 112 and heat exchange efficiency is prevented from being lowered. In this manner, it is possible to improve the performance of the air conditioner 300 in both of the cooling operation and the heating operation.

In addition, the three-way bend 4 is used as a branch portion of the refrigerant flow path of the paths during the heating operation. During the heating operation in which the heat exchanging unit 110 of the outdoor heat exchanger 12 is used as the evaporator, the liquid refrigerant flowing from the liquid-side outlet L2 is subjected to the heat exchanging with the outdoor air in the first row F1 of the outdoor heat exchanger 12 and becomes a gas-liquid mixed refrigerant. In three-way portions in the three-way bend 4, when viewed from a side connected to the end portion of the heat-transfer pipe 2 of the first row F1, a shape of the refrigerant flow path of the branch portion to the side connected to end portions of two heat-transfer pipes 2 of the second row F2 is a symmetrical shape (right-left even shape) (not illustrated). In this manner, the refrigerant collides with the three-way portions of the three-way bend 4 and branches therein, and thereby the ratios of the liquid refrigerant and the gas refrigerant of the refrigerant flowing from the gas-side inlet G1 and the gas-side inlet G2 are equal. Thus, it is possible to obtain substantially equal degrees of dryness or values of specific enthalpy in outlet portions of the evaporator. In this manner, the heat exchange performance increases during the heating operation, and thus it is possible to realize the highly efficient air conditioner 300.

In addition, for example, the heat exchanger disclosed in Patent Literature 2 has a configuration in which three-way piping having piping that connects from a position slightly below from the middle position of the heat exchanger to the top stage, and the three-way portion branching at the end of the piping is connected to heat-transfer pipes (refer to FIG. 1 in Patent Literature 2). With such a configuration, first, the three-way portion and the piping are connected by a brazing material having a high melting temperature so as to prepare the three-way piping, and then it is necessary to connect the heat-transfer pipes and the three-way piping with a brazing material having a low melting temperature. Therefore, reliability of goods is likely to be degraded due to an increase in man hours, or an occurrence of gas leakage defects by remelting of a brazed portion between the three-way portion and the piping. By comparison, in the outdoor heat exchanger 12 of the first embodiment, it is possible to manufacture the outdoor heat exchanger 12 by brazing the U-bend 3, the three-way bend 4, and connection pipe 5 to the heat-transfer pipes 2 such that it is possible to improve the heat exchange performance, to reduce the man hours of the manufacturing, and to achieve improvement of the reliability.

In addition as illustrated in FIGS. 1 and 3, the outdoor heat exchanger 12 of the air conditioner 300 according to the first embodiment includes the subcooler 120, and the subcooler 120 is disposed between the distributor 113 and the outdoor expansion valve 13 in the flowing direction of the refrigerant. In other words, the outdoor expansion valve 13 is disposed between the subcooler 120 and the subcooler 130.

In such a configuration, during the cooling operation of the air conditioner 300, the liquid refrigerants flowing from the paths of the heat exchanging unit 110 merge in the distributor 113 and flow to the subcooler 120. In this manner, a flow rate of the refrigerant increases and a refrigerant-side heat-transfer coefficient increases, and thereby the heat exchange performance of the outdoor heat exchanger 12 improves and the performance of the air conditioner 300 improves.

In addition, during the heating operation of the air conditioner 300, the liquid refrigerant that is subjected to the pressure reduction in the outdoor expansion valve 13 and a decrease in the refrigerant temperature flows into the subcooler 120. In this manner, a heat release amount in the subcooler 120 decreases, and thus it is possible to improve the performance coefficient COPc during the heating operation. The temperature of the refrigerant that flows to the subcooler 120 is lower than an outside temperature of the outdoor air Af during the heating operation, and thereby it is possible to preferably reduce the heat release amount in the subcooler 120.

In addition, as illustrated in FIG. 3, the subcooler 120 and the subcooler 130 are provided in the first row F1 of the outdoor heat exchanger 12, and the subcooler 130 is provided at the lowermost stage and the subcooler 120 is provided thereon.

Here, the eighth path (path flowing from gas-side inlets G15 and G16 of the outdoor heat exchanger 12 (heat exchanging unit 110) to a liquid-side outlet L8) is configured to have a first heat exchanging region of the second row F2 from the gas-side inlets G15 and G16 to the three-way bent 4 in which merging is performed, a second heat exchanging region of the first row F1 to which the connection pipe 5 is connected to an intermediate position thereof at the same stage (here, shifted by a half pitch for the zigzag arrangement) as the first heat exchanging region, and a third heat exchanging region of the second row F2 at the same stage (here, shifted by the half pitch for the zigzag arrangement) as the subcoolers 120 and 130.

According to such a configuration, during the cooling operation of the air conditioner 300, the flow of the refrigerant and the flow of the outdoor air Af become the pseudo counterflow in the first heat exchanging region and the second heat exchanging region. Although the third heat exchanging region is formed in the second row F2, the subcoolers 120 and 130 are provided at the same stage in the first row F1, the liquid refrigerant flows into the subcoolers 120 and 130 after the liquid refrigerant has been subjected to the heat exchanging in the heat exchanging unit 110. Therefore, the flow of the refrigerant also in the third heat exchanging region and the flow of the outdoor air Af become the pseudo counterflow. In addition, a liquid-side outlet L8 of the eighth path is provided on the downstream side of the subcooler 130 in the flowing direction of the outdoor air Af, and thereby the heat energy released from the subcooler 130 is efficiently collected in the third heat exchanging region of the eighth path during the heating operation of the air conditioner 300. In this manner, it is possible to improve the performance of the air conditioner 300 in both of the cooling operation and the heating operation.

In addition, in the first row F1 of the outdoor heat exchanger 12, the heat exchanging unit 110, the subcooler 120, and the subcooler 130 are aligned in this order when viewed in the vertical direction. With such disposition, during the heating operation, it is possible to dispose the subcooler 120 actuated at an intermediate temperature between the heat exchanging unit 110 functioning as the evaporator and the subcooler 130 having a high temperature with an aim of preventing the drain pan from freezing or the like, and thus it is possible to reduce a heat conduction loss through the fin 1. Similarly, during the cooling operation, it is possible to dispose the subcooler 120 actuated at an intermediate temperature between the heat exchanging unit 110 functioning as the condenser and the subcooler 130 through which the liquid refrigerant is subjected to the heat exchanging in the heat exchanging unit 110, is subjected to pressure reduction in the outdoor expansion valve 13, and flows to have a low temperature, and thus it is possible to reduce a heat conduction loss through the fin 1.

<Liquid-Side Distribution Pipe>

Next, the flow-path resistance (pressure loss) of the liquid-side distribution pipe 112 that connects the liquid-side outlets (L1, L2, and . . . ) of the paths of the heat exchanging unit 110 and the distributor 113 will be described.

It is desirable that the flow-path resistance (pressure loss) of the liquid-side distribution pipe 112 is set to converge in a range of ±20% for each distribution pipe of the paths.

Here, it is possible to express flow-path resistance ΔPLp [Pa] of the liquid-side distribution pipe 112 in Expression (5) using a pipe friction coefficient λ [−] of the liquid-side distribution pipe 112, a length L [m] of the liquid-side distribution pipe 112, an inner diameter d [m] of the liquid-side distribution pipe 112, refrigerant density ρ [kg/m$^3$], and a refrigerant flow rate u [m/s]. In addition, it is possible to express the pipe friction coefficient λ [−] in Expression (6) using a Reynolds number Re [−]. In addition, it is possible to express the Reynolds number Re [−] in Expression (7) using the refrigerant flow rate u [m/s], the inner diameter d [m] of the liquid-side distribution pipe 112, and a dynamic viscosity coefficient v [Pa·s].

$$\Delta PLp=\lambda\cdot(L/d)\cdot\rho u^2/2 \tag{5}$$

$$\lambda=0.3164\cdot Re^{-0.25} \tag{6}$$

$$Re=ud/\nu \tag{7}$$

In other words, it is desirable that the flow-path resistance ΔPlp of the liquid-side distribution pipe 112 that is obtained from Expression (5) is set to converge in a range of ±20% for each distribution pipe of the paths. Expression (5) is arranged by the length L [m] of the liquid-side distribution pipe 112 and the inner diameter d [m] of the liquid-side distribution pipe 112, and thereby it is desirable that the pressure-loss coefficient ΔPc expressed in the following Expression (8) is set to converge in a range of ±20% for each distribution pipe of the paths.

$$\Delta Pc=L/d^{5.25} \tag{8}$$

As illustrated in FIG. 2(*b*), in the outdoor device 100 in which the air is blown with respect to the outdoor heat exchanger 12 in the horizontal direction, substantially uniform vertical distribution of blow rate is obtained. In addition, as illustrated in FIG. 3, the heat exchanging unit 110 of the outdoor heat exchanger 12 includes a plurality of the refrigerant flow paths which are the same as in the first path. According to such a configuration, even when the flow-path resistance of the liquid-side distribution pipe 112 is not significantly adjusted (that is, adjusted in the range of ±20%), it is possible to obtain uniform refrigerant distribution. Further, a difference between the flow-path resistances of the liquid-side distribution pipes 112 is reduced (converges in the range of ±20%), a distance between the refrigerant distributions is unlikely to occur in both of the cooling operation and the heating operation.

In addition, it is desirable that the flow-path resistance (pressure loss) of the liquid-side distribution pipe 112 is set to be 50% or higher of a liquid head difference occurring due to a height dimension H [m] of the heat exchanger. In other words, when distribution-pipe resistance during an operation with cooling middle performance (performance of about 50% of rated performance) is ΔPLprc, it is desirable to satisfy Expression (9). Note that ρ represents refrigerant density [kg/m$^3$], and g represents gravitational acceleration [kg/s$^2$].

$$\Delta PLprc \geq 0.5\ \rho g H \quad (9)$$

In this manner, the performance is reduced to about 50% of the rated performance during the cooling operation, and it is possible to prevent deterioration of the refrigerant distribution due to the liquid head difference even during the operation in which the refrigerant pressure loss of the condenser is reduced, and it is possible to improve COP during the operation with the cooling middle performance.

Further, in a case where the height dimension H [m] of the heat exchanger is 0.5 m or higher, the satisfaction of Expression (9) is more effective because an effect of improving efficiency during the operation with the cooling middle performance increases. This is because, in a case where the height dimension H [m] of the heat exchanger is 0.5 m or higher, the head difference occurring on the refrigerant side increases, and the performance is likely to be degraded due to the distribution deterioration; however, the satisfaction of Expression (9) enables to appropriately prevent deterioration of the refrigerant distribution and it is possible to improve the COP during the operation with the cooling middle performance.

FIG. 4 is a diagram illustrating an influence of the flow-path resistance of the liquid-side distribution pipe 112 on performance in the configuration of the air conditioner 300 according to the first embodiment. In FIG. 4, the horizontal axis of the graph represents the flow-path resistance of the liquid-side distribution pipe 112, the vertical axis represents the COP during the operation of the cooling middle performance, the COP during the heating rated performance, and an annual performance factor (APF). A change in the COP during the operation of the cooling middle performance due to the flow-path resistance of the liquid-side distribution pipe 112 is represented by a solid line, a change in the COP during the heating rated performance due to the flow-path resistance of the liquid-side distribution pipe 112 is represented by a dashed line, and a change in the APF due to the flow-path resistance of the liquid-side distribution pipe 112 is represented by a dotted line. In addition, in FIG. 4, a region, in which Expression (9) is satisfied, is illustrated.

As illustrated in FIG. 4, in the configuration of the air conditioner 300 according to the first embodiment, the more the flow-path resistance of the liquid-side distribution pipe 112 increases, the more the COP during the operation of the cooling middle performance improves; however, the COP during the heating rated performance tends to decrease. The temperature of the subcooler 120 during the heating operation increases in response to the increase in the flow-path resistance of the liquid-side distribution pipe 112, and the heat release amount increases from the subcooler 120, and the COP decreases.

It is desirable to set the distribution-pipe resistance ΔPLpdt during a heating rated operation as in Expression (10) such that it is possible to increase the APF while reducing the decrease in the COP during the heating rated operation to the largest extent. Here, ΔTsat represents saturation temperature difference [K] due to the distribution-pipe resistance.

$$\Delta T\mathrm{sat}(\Delta PLpdt) \leq 5 \quad (10)$$

In this manner, it is possible to prevent the temperature of the subcooler 120 during the heating rated operation from being higher than the outside temperature, and it is possible to reduce the heat release loss and to improve the COP.

In addition, as the refrigerants used in the refrigeration cycle of the air conditioner 300 according to the first embodiment, it is possible to use a refrigerant obtained by selecting a single from or by mixing a plurality of R32, R410A, R290, R1234yf, R1234ze(E), R134a, R125A, R143a, R1123, R290, R600a, R600, or R744.

In particular, in the refrigeration cycle in which R32 (a mixed refrigerant containing only R32 or 70% by weight or higher of R32) or R744 is used as the refrigerant, it is possible to appropriately use the configuration of the air conditioner 300 according to the first embodiment. In a case where R32 (a mixed refrigerant containing only R32 or 70% by weight or higher of R32) or R744 is used, a pressure loss of the heat exchanger tends to be small, and deterioration in the distribution due to the liquid head difference of the refrigerant is likely to occur, compared to a case where another refrigerant is used. Therefore, a use of the air conditioner 300 according to the first embodiment enables to reduce the deterioration in the distribution of the refrigerant and enables the performance of the air conditioner 300 to improve.

In FIG. 3, in the description, the first path (path flowing from the gas-side inlets G1 and G2 to the liquid-side outlet L1) of the outdoor heat exchanger 12 (heat exchanging unit 110) merges in the three-way bend 4, flows upward while flowing along both ways in the first row F1 in the horizontal direction, and flows downward while flowing both ways in the horizontal direction along both ways from the heat-transfer pipe 2 that is immediately below the heat-transfer pipe 2 of the first row F1 that is connected to the three-way bend 4 via the connection pipe 5; however, the configuration of the refrigerant flow path is not limited thereto.

For example, as illustrated in FIG. 5(*a*), the path merges in the three-way bend 4, then, flows downward while flowing along both ways in the first row F1 in the horizontal direction, and flows upward while flowing along both ways in the horizontal direction from the heat-transfer pipe 2 that is immediately above the heat-transfer pipe 2 of the first row F1 that is connected to the three-way bend 4, via the connection pipe 5A.

In addition, as illustrated in FIG. 5(*b*), a configuration, in which the path merges in the three-way bend 4, then, flows upward while flowing along both ways in the first row F1 in the horizontal direction, and flows upward while flowing along both ways in the horizontal direction from the heat-transfer pipe 2 of the first row F1 that is at the same stage as the gas-side inlet G2 (here, shifted by the half pitch so as to form the zigzag arrangement) via the connection pipe 5B, may be employed. In addition, although not illustrated, a configuration, in which the path merges in the three-way bend 4, then, flows downward while flowing along both ways in the first row F1 in the horizontal direction, and flows downward while flowing along both ways in the horizontal direction from the heat-transfer pipe 2 of the first row F1 that is at the same stage as the gas-side inlet G1 (here, shifted by the half pitch so as to form the zigzag arrangement) via the connection pipe 5, may be employed.

In a case of the configuration as illustrated in FIG. 5(*b*), the heat-transfer pipe 2 of the first row F1 that is connected to the three-way bend 4 and the liquid-side outlet L1 approach each other. Therefore, as illustrated in FIGS. 3 and 5(*a*), the heat-transfer pipe 2 of the first row F1 connected to the three-way bend 4 and the liquid-side outlet L1 are configured to be separated from each other, and such a configuration is more desirable in that the heat conduction loss through the fin 1 is reduced.

<Merging Part of Refrigerant Flow Path>

Further, when the distribution of the degree of dryness in the distributor 113 is not considered when the heat exchanger functions as the evaporator, variations in the temperatures of the paths in the outlet of the evaporator are produced, and thus the performance is likely to be degraded.

In the air conditioner 300 in the example, a route, through which a plurality of the refrigerant flow paths from the subcooler 120 during the heating flow to the distributor 113, is configured as illustrated in FIG. 6(*b*). This route is provided with an inflow pipe 114 that is directly connected to the distributor 113, and a confluent pipe 115 that merges at an intermediate position of the inflow pipe. The confluent pipe 115 is connected to a merging part 116 of the inflow pipe 114 and is connected to be substantially perpendicular to the inflow pipe 114 and in the vicinity of the distributor 113.

FIG. 6(*a*) illustrates a common inflow piping shape to the distributor 113 and, since a bending portion is provided in an upstream portion, a liquid phase having a larger inertial force of gas-liquid two-phase flow in the inside unevenly gathers on an outer side of the bending portion, and thereby a problem arises in that uneven refrigerant distribution occurs in the distributor 113.

In this respect, in the air conditioner 300 of the example illustrated in FIG. 6(*b*), the inflow pipe 114 of the distributor 113 is provided with the merging part 116 immediately in front of the distributor 113 (at a distance Lf from the distributor 113 to the merging part 116), thereby the uneven gas-liquid two-phase flow is stirred, and the refrigerant distribution is evenly performed in the distributor 113.

Until the refrigerant reaches the merging part 116, the refrigerant having two phases that flows in the inflow pipe 114 and the confluent pipe 115 is separated into the liquid refrigerant and the gas refrigerant, and the liquid refrigerant forms an annular flow and flows along the wall surface of the piping. Then, two annular flows intersect with each other in the merging part 116, and thereby the liquid refrigerant and the gas refrigerant are stirred to have a gas-liquid mixed state and flow as spray flow. Since the spray flow flows through a predetermined distance, and then is subjected to a slow transition from a state in which the liquid refrigerant is mixed with the gas refrigerant to a separated state, it is desirable that the merging part 116 is positioned in the vicinity of the distributor 113.

FIG. 7 illustrates a detailed shape of the confluent pipe 115, and, with respect to a pipe inner diameter D1 of the merging part 116, the inflow pipe 114 and the confluent pipe 115 from the subcooler 120 have inner diameters d1 and d2 which are smaller than that of the merging part 116.

In addition, a distance Lf between the merging part 116 and the inlet of the distributor 113 is five times or shorter than the pipe inner diameter D1 of the merging part 116. With such setting, the gas-liquid two-phase flow is sufficiently stirred when merging such that the even distribution of the degree of the dryness is obtained in the distributor 113, and the refrigerant distribution of the evaporator is evenly performed such that it is possible to realize a highly efficient evaporator.

FIG. 8 illustrates characteristics disclosed in Japanese Patent Application Laid-Open No. 2013-178044 in which a ratio (Lf/D1) of a transition length to annular flow (described as bubble annular flow in the known patent literature) of spray flow (described as swirled flow in the known patent literature) generated on the downstream side of the expansion valve to a pipe inner diameter changes depending on a mass velocity G [kg/m$^2$s] and a relationship expressed in Expression (11) is satisfied. This Expression for the relationship indicates a range in which the refrigerant flows as the spray flow.

$$Lf/D1 \leq 1.2G^{0.36} \tag{11}$$

Since the inflow pipe 114 to the distributor 113 in the example is provided with the merging part 116 immediately before the distributor 113, and the gas-liquid two-phase flow has a mixed state similar to the spray flow generated on the downstream side of the outdoor expansion valve 13, similarly, it is possible to estimate a range of the mixed state from Expression (11).

Here, diamond-shaped signs (◆) shown in FIG. 8 represent an operation range of the air conditioner having rated heating performance corresponding to 14 [kW] using R32 as the refrigerant, and are calculated in the following conditions.

Refrigerant Mass Flow Rate Gr=0.008 to 0.083 [kg/s]

Merging part Inner Diameter D1=0.0107 [m]

In the conditions described above, a range of Lf/D1, in which the spray flow transitions to the annular flow, is 6.0 to 14.0. This indicates that it is possible to realize the even refrigerant distribution in the distributor 113 within the operation range, with a configuration in which the distance Lf between the merging part 116 and the distributor 113 is set to be six times or shorter than the merging part inner diameter (Lf/D1≤6) so as to be smaller than the range.

Note that Lf/D1≤7, in association with the range of Gr=0.012 to 0.083 [kg/s] which is frequently used in the operation range. On the other hand, in order to obtain a reliable brazing property, desirably, Lf/D1≥4.

Here, the reliable brazing property means that, in a case where brazing is performed at two close positions, one position of brazing is first performed, and then the other position of brazing is performed, the former is prevented from being remelted due to heating of the latter brazing. In other words, when brazing of the piping that is connected to a lower portion of the distributor 113 and brazing of the merging part 116 are performed, it is necessary to prevent a brazing material of a portion, in which previous brazing is performed, from being remelted due to an influence of heat produced when the next brazing is performed. The longer the distance between the brazed positions and the smaller the diameter of the piping, the smaller influence the other position can have. When Lf/D1>4, it is possible to prevent an occurrence of defect in brazed portions which are close to each other. In this manner, it is possible to reliably secure airtightness of the brazed portion, and to secure reliability of a product.

Next, FIG. 9 illustrates a layout view of internal piping when viewed from the rear surface side of the outdoor device 100 of the air conditioner 300. Here, FIG. 9 illustrates a configuration employed in a case where the liquid piping 30 and the gas piping 40 are connected to the outdoor device 100 on the rear surface side.

In order to install connection piping (30 and 40) on the rear surface side, routes of the liquid piping 30 and the gas piping 40 need to be provided from the liquid blocking valve 15 (not illustrated in FIG. 9) and the gas blocking valve 16 through the inside of the outdoor device 100 to the rear surface side. In other words, since cycle components such as the accumulator 17, the expansion valve 13, or the distributor 113 are not only provided, piping that connects the components is but also provided, the components need to be disposed to avoid spaces through which the liquid piping 30 and the gas piping 40 pass.

FIG. 10 illustrates a piping structure on the periphery of the distributor 113 according to the first embodiment, and piping, which connects the outdoor expansion valve 13 and the subcooler 130, or piping (the distributor inflow pipe 114 and the confluent pipe 115), which connects the distributor 113 and the subcooler 120, is densely disposed in one end portion S1 of the heat exchanging unit 110.

Here, the piping connected to the distributor 113 has a shape of having the merging part 116 immediately before the distributor 113 illustrated in FIG. 7, and the inner diameters d1 and d2 of the inflow pipe 114 and the confluent pipe 115, which are connected to the subcooler 120, are set to be smaller than the piping inner diameter D1 of the merging part.

The smaller piping diameters of the inflow pipe 114 and the confluent pipe 115 make it easy to have a piping shape so as to be prevented from interfering with the connection piping of the outdoor expansion valve 13 and the subcooler 130, and it is possible to empty the space in which the liquid piping 30 and the gas piping 40 are disposed.

In addition, the bending portion provided in the route of the inflow pipe 114 and the confluent pipe 115 to the merging part 116 causes the refrigerants in the two routes in the merging part 116 to collide with each other in the vertical direction and to be stirred, even in a case where the liquid refrigerant in the pipe unevenly gathers, and thereby it is possible to change the refrigerant, which flows to the distributor 113, to have a substantially even flowing mode in a cross section of the piping.

Further, regarding the shape of the merging part 116, through which vertical merging is performed, it is possible to reduce the brazed positions to the smallest extent, compared to another merging method in a case where installation is performed using Y-shaped bends, and the shape is superior regarding a decrease in manufacturing cost or securing of leakage reliability.

FIG. 11 is an external view of a state in which the space through which the connection piping (the liquid piping 30 and the gas piping 40) passes is emptied by using the piping shape, and illustrates that it is possible to secure sufficient installation space for the connection piping.

As described above, since the inlet piping of the distributor 113 is configured, and thereby it is possible to realize compact mounting in a housing of the outdoor device with the evenness of the refrigerant distribution maintained, it is possible to increase a dimension of the width of the heat exchanger to the largest extent, and to realize the highly efficient air conditioner.

Note that it is needless to say that it is possible to individually employ the distribution structure of the refrigerant, in which the merging part 116 is used, even in a case where the subcoolers 120 and 130 of the example are not provided, and thus it is possible to appropriately perform the refrigerant distribution, for example, by branching piping at an intermediate position, through which the gas-liquid two-phase refrigerant flows, and merging thereof on the upstream side of the distributor 113, in addition to a case of a structure in which two or more refrigerant flow paths need to merge.

Second Embodiment

Next, the air conditioner 300 according to a second embodiment will be described with reference to FIG. 12. FIG. 12 is a layout diagram of refrigerant flow paths in an outdoor heat exchanger 12A of the air conditioner 300 according to the second embodiment. FIG. 12 is a diagram obtained when viewing one end side S1 (refer to FIG. 2(*a*)) of the outdoor heat exchanger 12A.

The air conditioner 300 according to the second embodiment has a different configuration of the outdoor heat exchanger 12A, compared to the air conditioner 300 according to the first embodiment. Specifically, the outdoor heat exchanger 12A is different in that the heat-transfer pipes 2 are arranged in three rows (a first row F1, a second row F2, and a third row F3). The other configuration is the same, and the repeated description thereof is omitted.

As illustrated in FIG. 12, the gas refrigerants that flow from the gas-side inlets G1 and G2 flow in directions (in the upward direction by the refrigerant from the gas-side inlet G1 and in a downward direction by the refrigerant from the gas-side inlet G2) in which the refrigerant flow paths are separated from each other in the vertical direction while flowing along both ways through the heat-transfer pipes 2 of the third row F3 in the horizontal direction, and are separated to a predetermined position. Then, the refrigerants flow to the heat-transfer pipe 2 of the second row F2 via the U-bent in which the end portion of the heat-transfer pipe 2 of the third row F3 is connected to the end portion of the heat-transfer pipe 2 of the second row F2. Hereinafter, the flow of the refrigerant in the second row F2 and the first row F1 is the same as the first embodiment (refer to FIG. 3). In other words, the outdoor heat exchanger 12A of the second embodiment is configured to have the refrigerant flow path on the gas side, which extends with respect to the two rows of outdoor heat exchangers 12 (refer to FIG. 3).

In this manner, even in a case of a configuration in which three rows of the outdoor heat exchangers 12A are provided, it is possible to more improve the high efficiency of the air conditioner 300 in the same manner as the case of the two rows (refer to FIG. 3).

Third Embodiment

Next, the air conditioner 300 according to a third embodiment will be described with reference to FIG. 13. FIG. 13 is a layout diagram of the refrigerant flow paths in an outdoor heat exchanger 12B of the air conditioner 300 according to the third embodiment. FIG. 13 is a diagram obtained when viewing one end side S1 (refer to FIG. 2(*a*)) of the outdoor heat exchanger 12B.

The air conditioner 300 according to the third embodiment has a configuration in which the outdoor heat exchanger 12B has three rows (the first row F1, the second row F2, and the third row F3) of heat-transfer pipes 2 which are arranged, similar to the air conditioner 300 according to the second embodiment. On the other hand, the outdoor heat exchanger 12B of the third embodiment is different in that the three-way bents 4 are disposed between the third row F3 and the second row F2, compared to the outdoor heat exchanger 12A of the second embodiment in which the three-way bents 4 are disposed between the second row F2 and the first row F1. The other configuration is the same, and the repeated description thereof is omitted.

As illustrated in FIG. 13, the flow of the refrigerant in the third row F3 and the second row 2 in the outdoor heat exchanger 12B of the third embodiment is the same as the flow of the refrigerant in the second row F2 and the first row F1 in the outdoor heat exchanger 12 of the first embodiment. The refrigerant flows into the heat-transfer pipe 2 of the first row F1 via a U-bent connected from the end portion of the heat-transfer pipe 2 of the second row F2 in the same stage as the gas-side inlet G2 to the end portion of the heat-transfer pipe 2 of the first row F1 in the same stage as the gas-side inlet G2. The refrigerant that flows into the heat-transfer pipe 2 of the first row F1 from the U-bent flows upward while flowing along both ways in the heat-transfer pipe 2 of the first row F1 in the horizontal direction, and flows out to the liquid-side distribution pipe 112 through the liquid-side outlet L1 on the same stage as the gas-side inlet G1. In other words, the outdoor heat exchanger 12B of the third embodiment is configured to have the refrigerant flow path on the liquid side, which extends with respect to the two rows of outdoor heat exchangers 12 (refer to FIG. 3).

In this manner, even in the case of the configuration in which three rows of the outdoor heat exchangers 12B are provided, it is possible to much more improve the high efficiency of the air conditioner 300 in the same manner as the case of the two rows (refer to FIG. 3). In addition, a length of the flow path of the refrigerant flow path (refrigerant flow path on the liquid side) after the merging in the three-way bent 4 is increased, and thus a region in which the refrigerant flow rate in the heat-transfer pipe 2 is relatively high is increased.

It is desirable to select any one of whether the number of paths and the position of the three-way bends 4 are disposed between the second row F2 and the first row F1 as in the second embodiment so as to have the optimal refrigerant rate depending on the rated performance, a total length of the heat-transfer pipes, an cross-sectional area of the heat-transfer pipe, and types of refrigerants of the air conditioner 300 (refer to FIG. 12), or the three-way bends are disposed between the third row F3 and the second row F2 as in the third embodiment (refer to FIG. 13). In this manner, it is possible to further improve the performance of the heat exchanger.

In addition, compared to the refrigerant R410A which is mainly used currently, the pressure loss in the refrigerant flow path is relatively small in a case where R32, R744, or the like is used as the refrigerant. Therefore, the length of the flow path after the merging on the liquid side as in the third embodiment (refer to FIG. 13) is selected to be long, and thereby it is possible to maximize the performance of the outdoor heat exchanger 12B and the air conditioner 300 that includes the outdoor heat exchanger.

Modification Example

The air conditioners 300 according to the embodiments (first to third embodiments) are not limited to the configurations of the embodiments, and it is possible to perform various modifications within a range without departing from the gist of the invention.

As described above, the examples of the air conditioner 300 are described; however, the invention is not limited thereto, and the invention can be widely applied to a refrigeration-cycle apparatus that includes the refrigeration cycle. The invention can be widely applied to a refrigerated-heating show case in which it is possible for items to be refrigerated or heated, a vending machine that refrigerates or heats beverage cans, or a refrigeration-cycle apparatus that includes the refrigeration cycle in a heat pump type water heater in which a liquid is heated and stored, or the like.

In addition, the examples of having two rows or three rows of the outdoor heat exchanger 12 (12A or 12B) in the flowing direction of the outdoor air; however, the configuration is not limited thereto, and four or more rows thereof may be used.

In addition, similar to the outdoor heat exchanger 12 (12A or 12B), the indoor heat exchanger 22 may include a plurality of configurations of paths P (refer to FIG. 3) of refrigerant flow paths. In addition, the configuration of the liquid-side distribution pipe 112 of the outdoor heat exchanger 12 may be applied to the liquid-side distribution pipe 212 of the indoor heat exchanger 22.

REFERENCE SIGNS LIST

1: fin
2: heat-transfer pipe
3: U pipe
4: three-way pipe
5: connection pipe
10: compressor
11: four-way valve
12: outdoor heat exchanger
13: outdoor expansion valve
14: receiver
15: liquid blocking valve
16: gas blocking valve
17: accumulator
21: indoor expansion valve
22: indoor heat exchanger
30: liquid piping
40: gas piping
50: outdoor fan
60: indoor fan
100: outdoor device
200: indoor device
300: air conditioner
110: heat exchanging unit
111: gas header
112: liquid-side distribution pipe
113: distributor
114: inflow pipe
115: confluent pipe
116: merging part
120: subcooler
130: subcooler
S1: one end portion
S2: the other end portion
F1: first row (row of a plurality of heat-transfer pipes)
F2: second row (row of a plurality of heat-transfer pipes)
F3: third row (row of a plurality of heat-transfer pipes)
G1, G2: gas-side inlet
L1: liquid-side outlet
Lf: distance between distributor and merging part
D1: merging part inner diameter
d1: inflow-pipe inner diameter
d2: confluent pipe inner diameter

The invention claimed is:

1. A heat exchange apparatus comprising:

a heat-transfer pipe through which a refrigerant flows;

a heat exchanger, exchanging heat between air and the refrigerant, in which a plurality of the heat-transfer pipes are connected to one another;

a distributor that distributes the refrigerant to the plurality of heat-transfer pipes;

an inflow pipe that causes gas-liquid two-phase refrigerant to flow into the distributor; and a confluent pipe which is connected to an intermediate position of the inflow pipe and in which gas-liquid two-phase refrigerant flowing through an inside thereof is to merge with the refrigerant flowing through an inside of the inflow pipe, wherein a merging part between the inflow pipe and the confluent pipe is positioned in a range of $4 \leq Lf/D1 \leq 7$, where Lf is a distance between the merging part and the distributor and D1 is a pipe inner diameter of the merging part, and wherein the confluent pipe is connected to the inflow pipe so that both gas-liquid two-phase flows merge to become a gas-liquid mixed spray flow.

2. A heat exchange apparatus comprising:

a heat-transfer pipe through which a refrigerant flows;

a heat exchanger, exchanging heat between air and the refrigerant, in which a plurality of the heat-transfer pipes are connected to one another;

a distributor that distributes the refrigerant to the plurality of heat-transfer pipes;

an inflow pipe that causes the refrigerant to flow into the distributor; and a confluent pipe which is connected to an intermediate position of the inflow pipe and in which the refrigerant flowing through an inside thereof is to merge with the refrigerant flowing through an inside of the inflow pipe, wherein a merging part between the inflow pipe and the confluent pipe is positioned in a range of $4 \leq Lf/D1 \leq 7$, where Lf is a distance between the merging part and the distributor and D1 is a pipe inner diameter of the merging part, and wherein a pipe inner diameter of the merging part is larger than each of pipe inner diameters of the confluent pipe and the inflow pipe before the merging occurs.

3. The heat exchange apparatus according to claim 1, wherein the refrigerant contains 70% by weight or higher of R32, and wherein the distance Lf between the merging part and the distributor is six times or less than the pipe inner diameter D1 of the merging part.

4. The heat exchange apparatus according to claim 1, wherein the distance Lf between the merging part and the distributor is four times or greater than the pipe inner diameter D1 of the merging part.

5. The heat exchange apparatus according to claim 1, further comprising:

an expansion valve that is provided in a refrigerant flow path and reduces pressure of the refrigerant; and a branch portion in which the refrigerant flowing out from the expansion valve branches, wherein the heat exchanger has a first subcooler through which the refrigerant branching from the branch portion flows, and wherein the refrigerant branched merges in the merging part.

6. The heat exchange apparatus according to claim 5, wherein the heat exchanger further has a second subcooler through which the refrigerant flows in front of the expansion valve.

7. The heat exchange apparatus according to claim 1, wherein a relationship between the distance Lf between the merging part and the distributor, a pipe inner diameter D1 of the merging part, and a mass velocity G [kg/(m2s)] of the refrigerant is Lf/D1 is less than or equal to $1.2*G^{0.36}$.

8. An air conditioner comprising:

a compressor;

an outdoor heat exchanging unit; and an indoor heat exchanging unit, wherein at least one of the outdoor heat exchanging unit and the indoor heat exchanging unit includes the heat exchange apparatus according to claim 1.

* * * * *